US011807004B2

(12) United States Patent
Suzuki et al.

(10) Patent No.: US 11,807,004 B2
(45) Date of Patent: Nov. 7, 2023

(54) INKJET HEAD AND IMAGE FORMING METHOD

(71) Applicant: KONICA MINOLTA, INC., Tokyo (JP)

(72) Inventors: Ayako Suzuki, Saitama (JP); Akihisa Shimomura, Atsugi (JP); Akihisa Yamada, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/052,964

(22) PCT Filed: May 9, 2018

(86) PCT No.: PCT/JP2018/017977
§ 371 (c)(1),
(2) Date: Nov. 4, 2020

(87) PCT Pub. No.: WO2019/215851
PCT Pub. Date: Nov. 14, 2019

(65) Prior Publication Data

US 2021/0245506 A1 Aug. 12, 2021

(51) Int. Cl.
*B41J 2/14* (2006.01)
*B41J 2/16* (2006.01)

(52) U.S. Cl.
CPC ..... *B41J 2/1433* (2013.01)

(58) Field of Classification Search
CPC ..... B41J 2/1433; B41J 2/162
See application file for complete search history.

(56) References Cited

U.S. PATENT DOCUMENTS 5,136,310 A * 8/1992 Drews ..... B41J 2/1606 347/45
2008/0313901 A1* 12/2008 Bich ..... B41J 2/1623 29/890.1
2011/0134188 A1* 6/2011 Arakawa ..... B41J 2/1606 156/247
2014/0085380 A1* 3/2014 Uno ..... B41J 2/1606 347/45

(Continued)

FOREIGN PATENT DOCUMENTS

CN 103660575 A 3/2014
CN 107521231 A 12/2017

(Continued)

OTHER PUBLICATIONS

International Preliminary Report on Patentability and Written Opinion of the International Searching Authority; for International Application No. PCT/JP2018/017977; dated Nov. 10, 2020.

(Continued)

*Primary Examiner* — Jason S Uhlenhake
(74) *Attorney, Agent, or Firm* — CANTOR COLBURN LLP

(57) ABSTRACT

Provided is an inkjet head containing: a substrate having a nozzle hole, and a nozzle plate having a liquid repellent layer on an outermost surface of the substrate on an ink discharge surface side, wherein the nozzle plate has a conductive layer between the substrate and the liquid repellent layer.

16 Claims, 6 Drawing Sheets

(56) References Cited

U.S. PATENT DOCUMENTS

| | | | | |
|---|---|---|---|---|
| 2015/0352855 | A1* | 12/2015 | Nawano | B41J 2/17513 347/93 |
| 2017/0361610 | A1* | 12/2017 | Hara | B41J 2/1433 |
| 2018/0339517 | A1* | 11/2018 | Saiba | B41J 2/164 |
| 2019/0118532 | A1* | 4/2019 | Seki | B41J 2/1609 |
| 2019/0352522 | A1* | 11/2019 | Hayashi | C09D 11/322 |

FOREIGN PATENT DOCUMENTS

| | | | |
|---|---|---|---|
| JP | 2000203033 | A | 7/2000 |
| JP | 2003341079 | A | 12/2003 |
| JP | 2005088357 | A | 4/2005 |
| JP | 2006082445 | A | 3/2006 |
| JP | 2007021840 | A | 2/2007 |
| JP | 2007190756 | A | 8/2007 |
| JP | 2010143106 | A | 7/2010 |
| JP | 2011068023 | A | 4/2011 |
| JP | 2011121218 | A | 6/2011 |
| JP | 2011131396 | A | 7/2011 |
| JP | 2011156845 | A | 8/2011 |
| JP | 2017226100 | A | 12/2017 |

OTHER PUBLICATIONS

CNIPA The First Office Action for corresponding CN Application No. 201880093175.8; dated Aug. 6, 2021.

International Search Report for International Application No. PCT/JP2018/017977; dated Jun. 19, 2018.

JPO Notice of Reasons for Refusal for corresponding JP Application No. 2020-517681; dated Oct. 26, 2021.

JPO Decision of Refusal for corresponding JP Application No. 2020-517681; dated Jan. 11, 2022.

CNIPA The Second Office Action for corresponding CN Application No. 201880093175.8; dated May 7, 2022.

* cited by examiner

INKJET HEAD AND IMAGE FORMING METHOD

CROSS REFERENCE TO RELATED APPLICATIONS

This is the U.S. national stage of application No. PCT/JP2018/017977, filed on May 9, 2018, the entire contents of which is incorporated herein by reference.

TECHNICAL FIELD

The present invention relates to an inkjet head and an image forming method. More particularly, the present invention relates to an inkjet head having a nozzle plate having excellent ejection stability and adhesion by reducing nozzle surface adhesion of ink droplets due to charging at the time of ink ejection, and an image forming method capable of obtaining a high-quality inkjet recording image using the same.

BACKGROUND

The inkjet recording apparatus, which is widely used at present, holds an inkjet head having a nozzle plate in which a plurality of nozzle holes are formed in rows in a frame by attaching it to a frame, and ejects ink from the plurality of nozzles toward the recording medium in a state of minute droplets, thereby forming an image on the recording medium.

As a typical ink ejection method of an inkjet head, there are a method in which water in ink is vaporized and expanded by heat generated by passing a current through an electric resistor disposed in a pressurizing chamber to discharge by applying pressure to ink, and a method in which a part of a flow passage member constituting a pressurizing chamber is made to be a piezoelectric body, or a piezoelectric body is installed in a flow passage member, and a piezoelectric body corresponding to a plurality of nozzle holes is selectively driven, so that a pressurizing chamber is deformed based on the dynamic pressure of each piezoelectric body to discharge liquid from the nozzle.

In inkjet heads, the surface characteristics of the surface on which nozzles are provided have become very important in realizing good ejection performance of ink droplets.

When ink droplets or dust adhere to the vicinity of the nozzle hole of the inkjet head, the ejection direction of the ink droplets to be ejected is bent, or the ejection angle of the ink droplets at the nozzle hole is expanded, resulting in the occurrence of satellites.

Further, problems such as a minute decrease in the ink discharge amount or no discharge (also referred to as nozzle missing) occur due to clogging of the nozzle hole. Also, when the adhered ink covers the entire surface of the nozzle hole, it becomes impossible to discharge. These develop into serious problems that significantly degrade the resolution and quality of the image to be formed.

In order to stably eject straight ink droplets, it is of course necessary to optimize the design in the flow path and the method of applying pressure to the ink, but this is not enough. It is necessary to always maintain a stable surface condition around the nozzle hole for ejecting the ink further at all times. For this purpose, a method of giving liquid repellency to prevent unnecessary ink from adhering to and remaining in the periphery of the nozzle hole of the ink discharge surface of the nozzle plate has been examined.

Generally, a silicone-based compound, or a fluorine-containing organic compound is used as a material for ink repellent treatment of a surface provided with a nozzle hole. Conventionally, a fluorine-containing organic compound such as a compound having a perfluoroalkyl group and a compound having a perfluoropolyether group has been known as a fluorine-containing organic compound exhibiting good liquid repellency.

As a result of examining the characteristics of the ink droplets on the ejection surface of the nozzle plate, the inventors of the present application has found that the ink repellent treatment using the fluorine-containing organic compound as described above alone is insufficient in order to obtain a more stable ink ejection performance and an inkjet image of high quality.

Generally, an inkjet head ejects various types of ink such as an aqueous ink, an organic solvent-based ink, and an active light curable solvent ink.

In the process in which the ink flows in the flow passage of the inkjet head and is ejected from the nozzle hole, due to flow charging in the flow path and jet charging in the vicinity of the nozzle hole, charge transfer occurs between the ink and the constituent members of the inkjet head, and the ink and the constituent members of the inkjet head are charged with opposite polarities.

The amount of charge due to ejection charging is generally large in an aqueous ink, and is small in an organic solvent-based ink, but even in an organic solvent-based ink, when the constituent material of the nozzle plate is a fluorine-based resin, the amount of charge is remarkably increased.

That is, on a nozzle plate having a liquid repellent layer having an uppermost surface containing a fluorine-based compound, when ink is ejected, the vicinity of the nozzle hole is also largely and easily charged.

The charged nozzle plate attracts ink mist charged to the opposite polarity and this ink mist accumulates on the nozzle plate, eventually becoming an obstacle around the nozzle hole, preventing stable ejection.

In order to solve the above problems, disclosed is a method of reducing an amount of electrical charge in a nozzle plate by establishing electrical continuity between a frame of a conductor and a conductive member on a side surface or a surface of a nozzle plate having a metal substrate (for example, refer to Patent Document 1). However, in the above-described method, since the substrate for the nozzle plate which may be applied is limited to the metal material, a substrate such as a non-metallic substrate may not be applied.

Further, in a form covering the entire periphery of the nozzle plate, an inkjet head attached with a nozzle cover having conductivity is disclosed (for example, refer to Patent Document 2). However, in the above-described disclosed configuration, since the nozzle cover protrudes out by the thickness of the newly provided nozzle cover, it is difficult to maintain the vicinity of the nozzle and to control the gap between the recording medium and the inkjet head. Further, there is a problem in that the formation region of the liquid repellent layer on the nozzle plate is narrowed by the installation of the nozzle cover.

Further, a nozzle forming member is disclosed in which a nozzle forming member for forming a nozzle hole is made of a silicon substrate, a conductive layer is provided on the ink discharge surface side of the silicon substrate, and a liquid repellent layer is formed thereon by a plating method (for example, refer to Patent Document 3). The above method is limited to a silicon nozzle plate and has low versatility.

PRIOR ART DOCUMENTS

Patent Documents

Patent Document 1: JP-A 2007-190756
Patent Document 2: JP-A 2003-341079
Patent Document 3: JP-A 2000-203033

SUMMARY OF THE INVENTION

Problems to be Solved by the Invention

The present invention has been made in view of the above-mentioned problems and situation. An object of the present invention is to provide an inkjet head having a nozzle plate excellent in liquid repellency, preventing adhesion of ink droplets to a nozzle surface due to charge at the time of ink ejection, excellent in ejection stability, and excellent in adhesion of a constituent layer, and an image forming method using the same, which may obtain a high-quality inkjet recording image.

Means to Solve the Problems

As a result of intensive investigation in view of the above problems, the present inventor has found that an inkjet head including a nozzle plate having a liquid repellent layer on the outermost surface on a ink discharge surface side of a substrate, wherein the nozzle plate has a conductive layer between the substrate and the liquid repellent layer, is excellent in liquid repellency on the ink discharge surface of the nozzle plate, and is capable of quickly reducing charge at the time of ink ejection. As a result, it is possible to prevent ink mist, which is a fine ink droplet generated at the time of ink ejection, from adhering to and accumulating on the ink discharge surface of the nozzle plate, is excellent in ejection stability, and is excellent in adhesiveness of a constituent layer, and has led to the present invention.

In other words, the above problem according to the present invention is solved by the following means.

1. An inkjet head comprising: a substrate having a nozzle hole; and a nozzle plate having a liquid repellent layer on an outermost surface of the substrate on an ink discharge surface side, wherein the nozzle plate has a conductive layer between the substrate and the liquid repellent layer.
2. The inkjet head according to item 1, wherein a sheet resistance on the ink discharge surface side of the nozzle plate is equal to or less than ⅔ of a sheet resistance on a liquid repellent layer side of a plate having a configuration excluding only the conductive layer from the nozzle plate.
3. The inkjet head according to item 1 or 2, wherein a sheet resistance on the ink discharge surface of the nozzle plate is equal to or less than $5.0\times10^{14}$ Ω/sq.
4. The inkjet head according to any one of items 1 to 3, wherein the nozzle plate has an adhesion layer between the substrate and the conductive layer.
5. The inkjet head according to any one of items 1 to 3, wherein the nozzle plate has an underlayer between the substrate and the liquid repellent layer.
6. The inkjet head according to any one of items 1 to 3, wherein the nozzle plate has an adhesion layer between the substrate and the conductive layer, and has an underlayer between the substrate and the liquid repellent layer.
7. The inkjet head according to any one of items 1 to 6, wherein the substrate is a non-metallic material.
8. The inkjet head according to item 5 or 6, wherein the underlayer contains one or more kinds of metal elements selected from the group consisting of tantalum, zirconium, hafnium, niobium, titanium, tungsten, cobalt, molybdenum, vanadium, lanthanum, manganese, chromium, yttrium, praseodymium, ruthenium, rhodium, iridium, cerium, and aluminum, and contains one or more kinds of elements selected from the group consisting of oxygen, nitrogen, and carbon.
9. The inkjet head according to item 5 or 6, wherein the underlayer contains a compound selected from the group consisting of silicon oxide, oxidized silicon carbide, tantalum silicate, and carbonized silicon oxide.
10. The inkjet head according to item 5 or 6, wherein the underlayer is made of polyamide or isocyanate.
11. The inkjet head according to any one of items 1 to 10, wherein the substrate is made of silicon, polyimide, polyphenylene sulfide, or polyethylene terephthalate.
12. The inkjet head according to any one of items 1 to 11, wherein the liquid repellent layer contains a fluorine-based compound, and the fluorine-based compound is either (1) or (2):
    (1) a compound having a perfluoroalkyl group containing at least an alkoxysilyl group, a phosphonic acid group or a hydroxy group, or a compound having a perfluoropolyether group containing an alkoxysilyl group, a phosphonic acid group or a hydroxy group; or
    (2) a mixture comprising a compound having a perfluoroalkyl group, or a mixture comprising a compound having a perfluoropolyether group.
13. The inkjet head according to any one of items 1 to 12, wherein in the nozzle plate, the substrate is formed of a resin material and the conductive layer is formed of a sublimable compound.
14. The inkjet head according to item 13, wherein the sublimable compound constituting the conductive layer is a tin-doped indium oxide or a carbon material.
15. The inkjet head according to any one of items 1 to 12, wherein in the nozzle plate, the substrate is formed of a resin material, and the conductive layer is formed of an organic conductive polymer.
16. An image forming method using the inkjet head according to any one of items 1 to 15, comprising the step of forming an image using an ink, wherein the ink contains a hydrocarbon having an ether group or a hydroxy group as a solvent in an amount of 40% by mass or more based on the total mass of the ink.

Effects of the Invention

According to the present invention, it is possible to provide an inkjet head having a nozzle plate excellent in liquid repellency and charge elimination performance at the time of ink ejection, excellent in prevention of adhesion of ink droplets to a nozzle surface, excellent in ejection stability, and excellent in adhesion of a constituent layer, and it is possible to provide an image forming method capable of obtaining a high-quality inkjet recording image using the inkjet head.

The expression mechanism or action mechanism of the effect of the present invention is inferred as follows.

As described above, when the ink droplets are ejected from the nozzle plate provided with the liquid repellent layer, when the ink is ejected from the nozzle hole through the flow passage of the inkjet head, the ink is charged to a positive charge due to the flow charging in the flow passage or the ejection charging in the vicinity of the nozzle hole, and the liquid repellent layer surface of the inkjet head is charged to a negative charge.

In the case of the solvent-based ink, when the liquid repellent layer of the nozzle plate is composed of a fluorine-containing compound, the amount of charging by the ejection charging is remarkably increased, and when the ink is ejected, the nozzle hole is also easily charged to a large extent.

As a result, ink mist having opposite positive charges is electrically attracted to the surface of the liquid repellent layer of the negatively charged nozzle plate, causing the ink mist to accumulate on the nozzle plate and eventually become an obstacle around the nozzle hole, preventing stable ejection.

In the present invention, in view of the above-described problem, by providing at least a conductive layer between the substrate and the liquid repellent layer provided on the outermost surface at the lower portion of the liquid repellent layer when viewed from the ejection surface, the charged charge (negative) of the liquid repellent layer generated in the vicinity of the nozzle hole due to the ejection charging moves to the conductive layer and may be released to the outside of the system through the conductive layer. As a result, it is possible to maintain stable ink ejection performance for a long time without ink mist accumulating on the nozzle plate.

EMBODIMENTS TO CARRY OUT THE INVENTION

Figure 1:
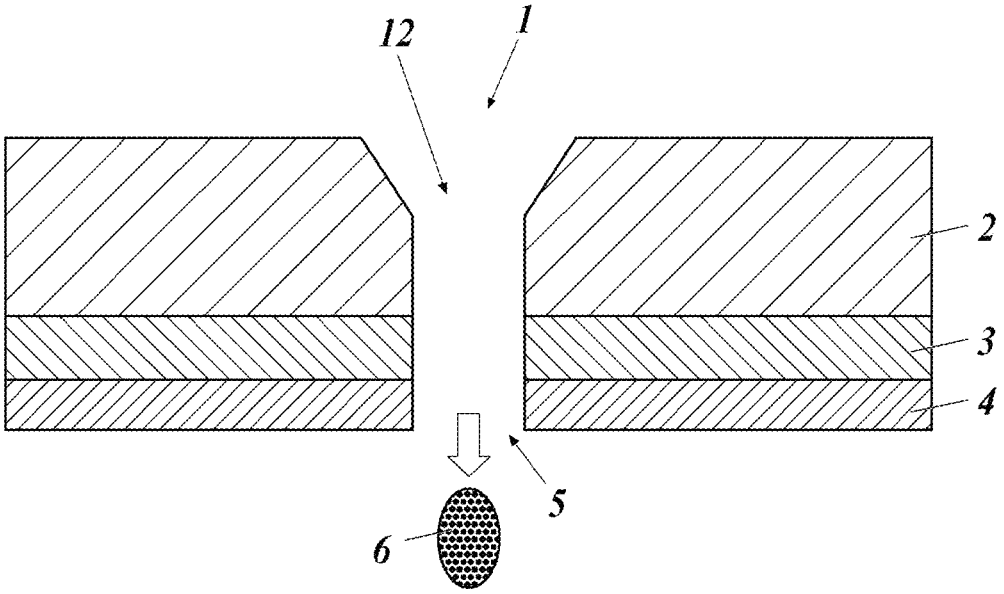
FIG. 1 is a schematic cross-sectional view showing an example of a configuration of a nozzle plate according to an embodiment of the present invention (embodiment 1).

The inkjet head of the present invention is characterized in that it includes a substrate having a nozzle hole, and a nozzle plate having a liquid repellent layer on the outermost surface of the substrate on the ink discharge surface side, and the nozzle plate has a conductive layer between the substrate and the liquid repellent layer. This feature is a technical feature common to the present invention according to each of the following embodiments.

In an embodiment of the present invention, from the viewpoint of further realizing the object effect of the present invention, particularly, when the sheet resistance on the ink discharge surface side of the nozzle plate having the conductive layer is not more than ⅔ (but not including 0) of the sheet resistance on the liquid repellent layer side of the plate having the configuration in which only the conductive layer is removed from the nozzle plate, or when the sheet resistance on the ink discharge surface side of the nozzle plate is equal to or less than $5.0\times10^{14}$ Ω/sq (but not including 0), the effect of preventing accumulation of ink mists on the nozzle plate is stably manifested.

In addition, it is preferable that the nozzle plate has a configuration in which an adhesion layer is further provided between the substrate and the conductive layer in order to improve the adhesion between the substrate and the conductive layer, and to prevent problems such as delamination even when the nozzle plate is used for a long period of time.

In addition, it is preferable that the nozzle plate has a configuration in which an underlayer is further provided between the conductive layer and the liquid repellent layer in order to improve the adhesion between the conductive layer and the liquid repellent layer, and to prevent problems such as delamination even when the nozzle plate is used for a long period of time.

As a method for forming the conductive layer, a chemical vapor deposition method (abbreviation: CVD, for example, thermal CVD method, plasma CVD method), or a physical vapor deposition method (abbreviation: PVD, for example, vacuum deposition (resistance heating deposition), electron beam deposition, ion plating, sputtering) may be used. Further, these methods may be used in combination as appropriate.

The conductive layer according to the present invention is characterized in that it is a layer composed of a material having current-carrying property.

The sheet resistance of the conductive layer is preferably $1.0\times10^{10}$ Ω/sq or less, more preferably $5.0\times10^{8}$ Ω/sq or less, and still more preferably $3.0\times10^{4}$ Ω/sq or less (excluding 0) measured by a double ring method based on JIS K 6911 and ASTM D257.

As the conductive layer according to the present invention, a first preferable form is that it is formed with a sublimable compound. Further, it may be used a method of: forming a conductive layer using a conductive carbon material or a metal compound as a sublimable compound with a vapor deposition method, for example; or a method of forming a conductive layer containing a resin component having a desired resistance value by using these materials as a fine particle dispersion liquid in a state of fine particles and dispersing them in a resin material (for example, a thermosetting resin, a thermoplastic resin, or an active energy ray-curable resin).

As the sublimable compound, particularly, a tin-doped indium oxide or a carbon material is preferably used.

In addition, as the conductive layer according to the present invention, a second preferable form is that it is formed with an organic conductive polymer.

As the organic conductive polymer, it may be a material which itself functions as a binder and forms a conductive resin layer, or it may be used a method of forming conductive resin fine particles by a conductive polymer compound and adding it in a dispersion state (resin emulsion) into an existing resin material to form a conductive resin layer.

Examples of the organic conductive polymer applicable to the present invention include chain-form conductive polymers such as polypyrroles, polyindoles, polycarbazoles, polythiophenes, polyanilines, polyacetylenes, polyfurans, polyparaphenylenevinylenes, polyazulenes, polyparaphenylenes, polyparaphenylenesulfides, polyisothianaphthenes, and polythiazils; and polyacene-based conductive polymers, but in the present invention, it is particularly preferable that the polymer is at least one cationic n-conjugated conductive polymer selected from polythiophenes, polyanilines, and polypyrroles.

Further, as a method of forming the underlayer, a chemical vapor deposition method, a physical vapor deposition method, a coating method using a solution material containing silicon (polysilazane, a silane coupling agent) may be used. Further, these methods may be used in combination as appropriate.

Further, as a method of forming an adhesion layer, a chemical vapor deposition method, a physical vapor deposition method, a coating method using a solution material containing silicon (polysilazane, a silane coupling agent) may be used. Further, these methods may be used in combination as appropriate.

Further, it is preferable that the substrate constituting the nozzle plate is made of a non-metallic material because the choice of methods for forming nozzle holes in the nozzle plate with high accuracy may be widened.

Further, it is preferable to use an organic resin such as polyimide, polyphenylene sulfide, or polyethylene terephthalate on the substrate in that it is possible to apply a nozzle hole formation by an excimer laser processing method.

Further, by using silicon as a substrate, it is possible to use a photolithography process used in the semiconductor process to the nozzle processing. By using such a machining process, high-precision nozzle machining becomes possible, and the ejection angle variation is very small, therefore, it is preferable in that it is possible to produce an inkjet head having a good drawing quality.

Further, as the liquid repellent layer according to the present invention, a fluorine-based compound is contained, and the fluorine-based compound is one of the following: (a) a compound having a perfluoroalkyl group containing at least an alkoxysilyl group, a phosphonic acid group or a hydroxy group; (b) a compound having a perfluoropolyether group containing an alkoxysilyl group, a phosphonic acid group or a hydroxy group; (c) a mixture comprising a compound having a perfluoroalkyl group, or a mixture comprising a compound having a perfluoropolyether group. By this configuration, high liquid repellency may be obtained when a liquid repellent layer is formed. Further, since the liquid repellent layer containing the fluorine-based compound having the above configuration has a large amount of electrification due to ejection electrification, the introduction of the conductive layer defined in the present invention is extremely effective.

Further, as a nozzle plate, the liquid repellent layer contains a fluorine compound, and the underlayer is composed of a material containing one or more kinds of metal elements selected from tantalum, zirconium, niobium, titanium, cobalt, molybdenum, lanthanum, manganese, chromium, yttrium, praseodymium, rhodium, iridium, cerium, and aluminum, and one or more kinds of elements selected from the group consisting of oxygen, nitrogen, and carbon. This is preferable in that the terminal of the constituent material of the liquid repellent layer containing a fluorine compound is easily bonded to the oxygen atom, nitrogen atom or carbon atom which constitutes the underlayer, and the interlayer adhesion is improved.

It is to be noted that, in this specification, an oxidized carbide indicates a product having a larger content of oxygen (number of atoms) than carbon in its composition, and for example, an oxidized silicon carbide indicates a product in which oxygen is contained in a range of 50 atomic % or more and 70 atomic % or less, carbon is contained in a range of 0.5 atomic % or more and 15 atomic % or less, and silicon is contained in a range of 25 atomic % or more and 35 atomic % or less.

In addition, a carbonized oxide indicates a product having a larger content of carbon (number of atoms) than oxygen in its composition, and for example, a carbonized silicon oxide indicates a product in which oxygen is contained in a range of 5 atomic % or more and 30 atomic % or less, carbon is contained in a range of 20 atomic % or more and 55 atomic % or less, and silicon is contained in a range of 25 atomic % or more and 35 atomic % or less. However, the above ranges are those measured using X-ray photoelectron spectroscopy (XPS: X-ray Photoelectron Spectroscopy). Further, the sum of the content ratios of the constituent elements does not exceed 100 atomic %.

Further, it is preferable that the liquid repellent layer contains a fluorine compound as a nozzle plate and the underlayer contains a compound selected from silicon oxide, oxidized silicon carbide, tantalum silicate, and carbonized silicon oxide in view of easy configuration of a bond between the terminal end of the constituent material of the liquid repellent layer containing the fluorine compound and the oxygen atoms constituting the underlayer, thereby improving interlayer adhesion.

Further, as a nozzle plate, it is preferable that the liquid repellent layer contains a fluorine compound, the substrate is made of a resin material, and the underlayer is made of polyamide or isocyanate in view of easy configuration of bonding with the terminal of the constituent material of the liquid repellent layer containing the fluorine compound, resulting in enhancing adhesion. In addition, it is preferable in terms of excellent machinability of a nozzle hole using an excimer laser.

Further, as a nozzle plate, it is preferable that the substrate is made of a non-metallic material and the adhesion layer is made of at least an oxide or a carbonized oxide of one selected from tantalum, zirconium, hafnium, titanium, ruthenium, rhodium, rhenium, iridium, aluminum, and silicon in view of the fact that the terminal of the constituent material of the substrate and the oxygen atom constituting the adhesion layer tend to form a bond and the adhesion between the layers is improved.

Further, as a nozzle plate, it is preferable that the liquid repellent layer contains a fluorine compound, the substrate is made of a resin material, and the conductive layer is formed of a sublimable compound, and further, the sublimable compound is made of a tin-doped indium oxide or a carbon material. This is because the sublimable substance is excellent in machinability of the nozzle hole by excimer laser.

Further, as a nozzle plate, it is preferable that the liquid repellent layer contains a fluorine compound, the substrate is made of a resin material, and the conductive layer is made of an organic conductive polymer in view of improving interlayer adhesion to each layer constituting the nozzle plate because the organic conductive polymer has a wide variety of functional groups. Further, since the organic conductive polymer has a C—C bond, laser ablation processing by an excimer laser becomes easy.

Hereinafter, the present invention and the constitution elements thereof, as well as configurations and embodiments to carry out the present invention, will be detailed in the following. In the present description, when two figures are used to indicate a range of value before and after "to", these figures are included in the range as a lowest limit value and an upper limit value.

<<Nozzle Plate>>

The inkjet head of the present invention is characterized in that a substrate having a nozzle hole, a liquid repellent layer on the outermost surface of the substrate on the ink discharge surface side, and a nozzle plate having a conductive layer between the substrate and the liquid repellent layer are provided thereto.

[Basic Configuration of Nozzle Plate]

First, a specific configuration of the nozzle plate according to the present invention will be described with reference to the drawings. Incidentally, in the description of each numeral, the numbers described in parentheses at the end of the component represents symbols in each figure.

FIG. 1 is a schematic cross-sectional view showing an example of a nozzle plate having a configuration defined in the present invention (embodiment 1).

As shown in FIG. 1, a basic configuration of a nozzle plate (1) according to the present invention includes a conductive layer (3) adjacent to a substrate (2), and further includes a liquid repellent layer (4) adjacent to the conductive layer (3).

Nozzle holes (5) are formed in the nozzle plate so as to penetrate the entire layer. In the nozzle plate shown in FIG. 1, ink is supplied from the upper surface side of the figure, and ink droplet (6) are ejected from the end of the nozzle hole (5) with respect to the recording medium surface. 12 is a nozzle through hole.

In the nozzle plate having the configuration shown in FIG. 1, the sheet resistance on the ink discharge surface side of the nozzle plate is set to be equal to or less than ⅔ (excluding 0) of the sheet resistance on the liquid repellent layer side of the plate having the configuration in which only the conductive layer (3) is removed from the nozzle plate, or the sheet resistance on the ink discharge surface side of the nozzle plate is set to be equal to or less than $5.0\times10^{14}$ Ω/sq (excluding 0).

As described above, when the ink droplet (6) is ejected from the nozzle hole (5), the ink droplet (6) or the minute ink droplet (ink mist) generated at the time of ejection is attracted to the surface of the liquid repellent layer (4) by the ejection charging, but the electric charge charged to the liquid repellent layer (4) is released by the conductive layer (3) provided adjacent to the liquid repellent layer (4), thereby preventing the ink droplet (6) from adhering and accumulating to the surface of the liquid repellent layer, and the nozzle hole ejection stability from decreasing.

Figure 2:
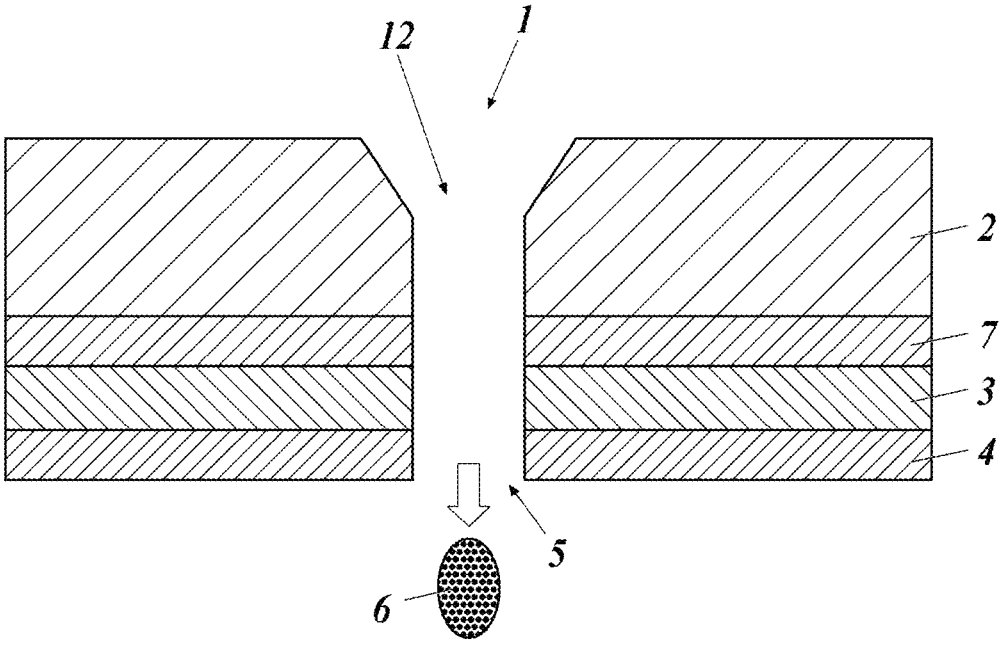
FIG. 2 is a schematic cross-sectional view showing another example of a configuration of a nozzle plate according to the present invention (embodiment 2).

FIG. 2 is a schematic cross-sectional view showing an embodiment 2 which is another example of the nozzle plate according to the present invention.

The nozzle plate (1) shown in FIG. 2 has a configuration in which an adhesion layer (7) is further provided between the substrate (2) and the conductive layer (3) in addition to the structure of the nozzle plate shown in FIG. 1. By this configuration, it is possible to obtain excellent ejection stability, and it is possible to improve the adhesion between the substrate (2) and the conductive layer (3). It is possible to obtain a nozzle plate (1) having excellent durability without delamination even when used for a long time.

Figure 3:
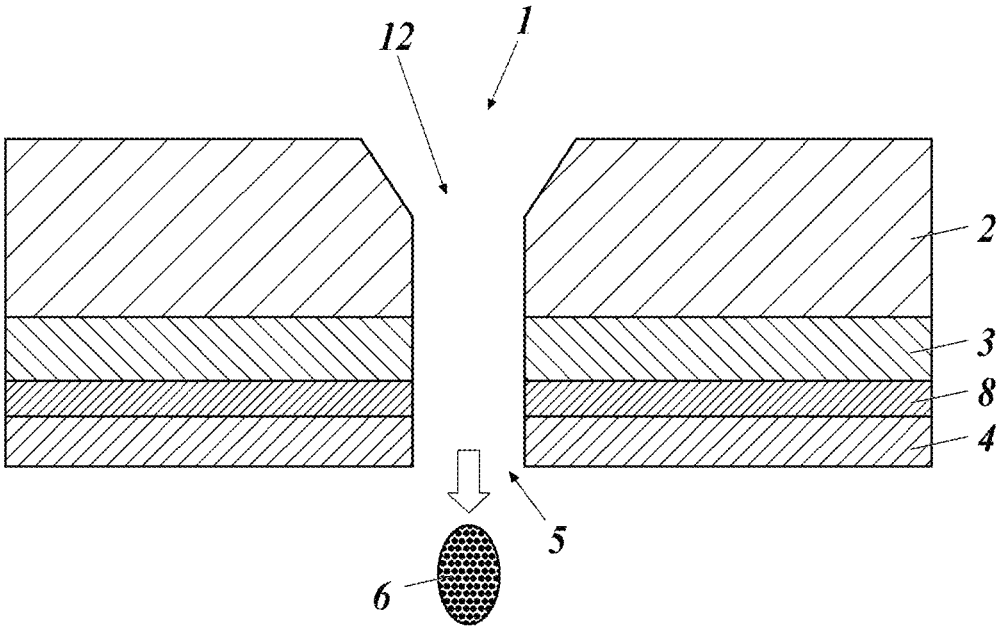
FIG. 3 is a schematic cross-sectional view showing another example of a configuration of a nozzle plate according to the present invention (embodiment 3).

FIG. 3 is a schematic cross-sectional view showing an embodiment 3 which is another example of the nozzle plate according to the present invention.

The nozzle plate (1) shown in FIG. 3 has a configuration in which an underlayer (8) is further provided between the conductive layer (3) and the liquid repellent layer (4) with respect to the configuration of the nozzle plate shown in FIG. 1, so that excellent ejection stability may be obtained by this configuration, and adhesion between the conductive layer (3) and the liquid repellent layer (4) may be improved, and even when used for a long time, a nozzle plate (1) having no delamination and excellent durability may be obtained.

Figure 4:
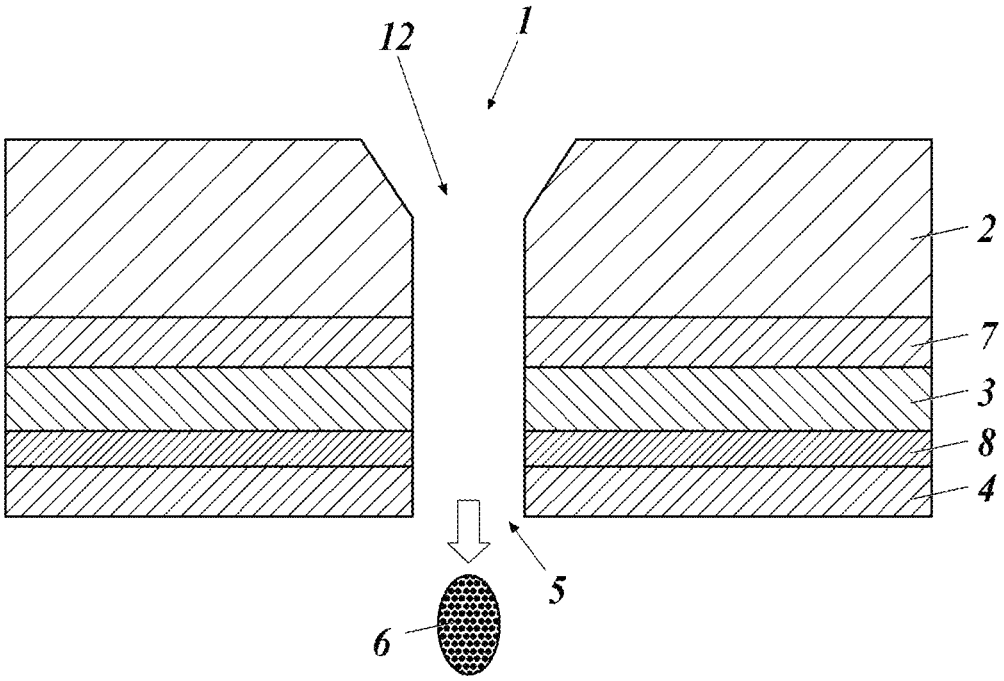
FIG. 4 is a schematic cross-sectional view showing another example of a configuration of a nozzle plate according to the present invention (embodiment 4).

FIG. 4 is a schematic cross-sectional view showing an embodiment 4 which is another example of the nozzle plate according to the present invention.

In the nozzle plate (1) shown in FIG. 4, as shown in FIG. 2, an adhesion layer (7) is provided between the substrate (2) and the conductive layer (3) with respect to the configuration of the nozzle plate shown in FIG. 1, and as shown in FIG. 3, a configuration in which an underlayer (8) is provided between the conductive layer (3) and the liquid repellent layer (4) is shown. With this configuration, excellent emission stability may be obtained, adhesion to the substrate (2), the conductive layer (3), and the liquid repellent layer (4) may be improved, and even when used for a long time, the nozzle plate (1) without delamination and excellent in durability may be obtained.

Figure 5:
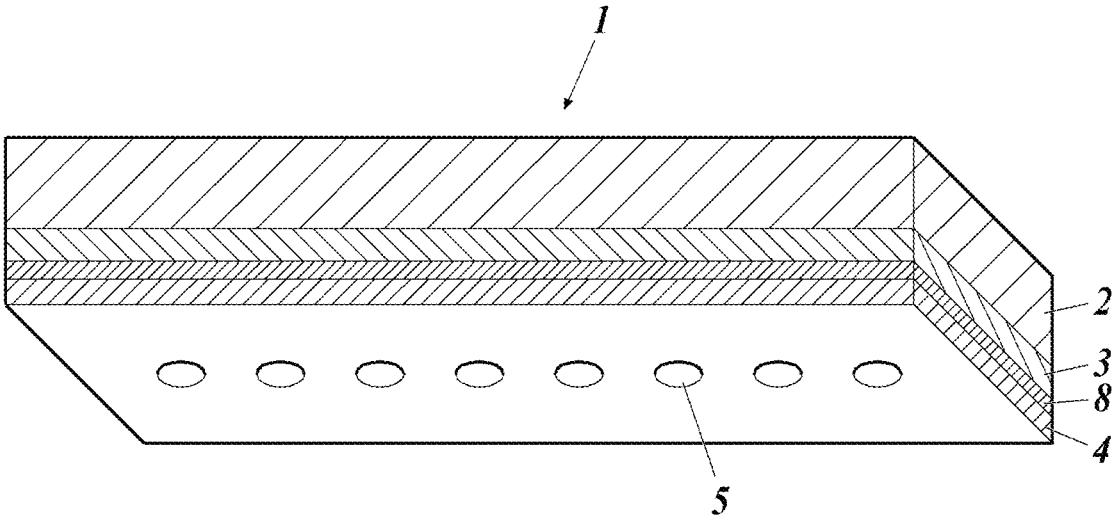
FIG. 5 is a perspective view from the lower surface side of the nozzle plate of the embodiment 3 described in FIG. 3.

FIG. 5 is a perspective view of the nozzle plate according to an embodiment 3 shown in FIG. 3, as seen from the side of the ejection surface.

As shown in FIG. 5, in the nozzle plate (1), a plurality of nozzle holes (5) are arranged on the ink discharge surface (liquid repellent layer forming surface side), and the nozzle plate (1) in such a form is mounted on the ink head.

<Sheet Resistance>

The nozzle plate according to the present invention is characterized in that the nozzle plate has a liquid repellent layer on the outermost surface of the substrate on the ink discharge surface side, and has a conductive layer between the nozzle plate and the liquid repellent layer. Preferably, when the sheet resistance on the ink discharge surface side of the nor plate having the conductive layer (hereinafter, this sheet resistance is defined as $R_A$) is equal to or less than ⅔ (not including 0) of the sheet resistance on the liquid repellent layer side of the plate having the configuration in which only the conductive layer is removed from the nozzle plate (hereinafter, this sheet resistance is defined as $R_B$), or when the sheet resistance $R_A$ on the ink discharge surface side of the nozzle plate is equal to or less than $5.0\times10^{14}$ Ω/sq (not including 0), it is desirable to develop the effect of preventing accumulation of ink mist on the nozzle plate.

More preferably, $R_A$ is in the range of $1/(1\times10^{22})$ to ⅔ of $R_B$, or $R_A$ is in the range of $1.0\times10^{4}$ to $5.0\times10^{14}$ Ω/sq, and more preferably $R_A$ is in the range of $1/(1\times10^{11})$ to ⅔ of $R_B$, or $R_A$ is in the range of $1.0\times10^{4}$ to $4.0\times10^{14}$ Ω/sq. Particularly preferably, $R_A$ is in the range of $1/(1\times10^{7})$ to ⅔ of $R_B$, or $R_A$ is in the range of $1.0\times10^{4}$ to $3.0\times10^{14}$ Ω/sq.

Further, also in the configurations shown in FIG. 2, FIG. 3, and FIG. 4, it is preferable that the sheet resistance $R_A$ on the ink discharge surface side of the nozzle plate is equal to or less than ⅔ (excluding 0) with respect to the sheet resistance $R_B$ on the liquid repellent layer side of the plate having the configuration in which only the conductive layer (3) is removed from the nozzle plate, or that the sheet resistance $R_A$ on the ink discharge surface side of the nozzle plate is equal to or less than $5.0\times10^4$ Ω/sq (excluding 0 Ω/sq).

In the present invention, the sheet resistance (Ω/sq) may be determined by measuring with a double-ring method in accordance with JIS K 6911, ASTM D257. The sheet resistance measurement is not necessarily limited to this method, and other alternative means may be used.

Specifically, a sheet sample of the nozzle plate 100 mm×100 mm or a sheet sample of a single film or a multilayered film under the same condition (base material, composition, layer thickness) as the nozzle plate may be measured using a super-insulating meter SM7110 and an electrode SME-8310 for a flat plate sample (both are made HIOKI E.E. Corporation).

Regarding the electrodes, the diameter of the main electrode is 5 cm, the inner diameter of the guard electrode is 7 cm, a voltage of 500 V is applied, and the value after 1 minute of voltage application is obtained. The same evaluation is performed 3 times on the same sample, and the average value is calculated. The obtained value may be used as a sheet resistance.

When the diameter of the main electrode: D1 (cm), the inner diameter of the guard electrode: D2 (cm), and the resistance value measured from the applied voltage and current value: r (Ω), the sheet resistance: R (Ω/sq) is obtained from the following equation.

$$R=r\times\pi(D1+D2)/(D2-D1)$$

In the case of the present embodiment, when D1=5 cm and D2=7 cm, R may be calculated from 18.84×r(Ω).

In addition, the methods (I) or (II) below may be used to determine that the sheet resistance $R_A$ on the ink discharge surface side of the nozzle plate is not more than ⅔ (except 0) of the sheet resistance $R_B$ on the liquid repellent layer side of the plate having the configuration in which only the conductive layer is removed from the nozzle plate.

(I) The sheet resistance $R_A$ of the ink discharge surface side of the nozzle plate or the multilayer film having the same condition (base material, composition, layer thickness) as the nozzle plate according to the present embodiment is equal to or less than ⅔ (excluding 0) of the sheet resistance $R_B$ of the liquid repellent layer side of the multilayer film having the configuration in which only the conductive layer is removed from the nozzle plate.

(II) Among the constituent layers constituting the nozzle plate according to the present invention, the sheet resistance (hereinafter, this sheet resistance is defined as $R_C$) obtained by single film separation of the conductive layer (3) or the sheet resistance (hereinafter, this sheet resistance is defined as $R_{C'}$) obtained by forming the conductive layer (3) on a substrate that may be separated under the same condition (composition, layer thickness) is equal to or less than ⅔ (except 0) of the sheet resistance $R_B$ on the liquid repellent layer side of the multilayer film having the constitution obtained by removing only the conductive layer from the nozzle plate.

The reason why (II) may be applied is as follows. The measurement current in the sheet resistance measurement has a property of flowing through a layer having higher conductivity, and the conductive layer (3) among the constituent layers of the nozzle plate according to the present invention has higher conductivity. As a result, the measurement current of the sheet resistance $R_A$ on the ink discharge surface side of the nozzle plate used in (I) mainly flows through the conductive layer (3). Therefore it may be considered that the magnitude of $R_A$ is equal to or more of the sheet resistance R of the single peeled film of the conductive layer (3) used in (II), or is equal to or more of the sheet resistance $R_{C'}$ of the conductive layer (3) formed on a peelable substrate under the same conditions (composition and layer thickness).

Further, the determination that the sheet resistance $R_A$ on the ink discharge surface of the nozzle plate was equal to or less than $5.0\times10^{14}$ Ω/sq (except for 0) was made using the following (III).

(III) The sheet resistance $R_A$ of the ink discharge surface side of the nozzle plate according to the present invention or of the multilayered film having the same condition (base material, composition, layer thickness) of the nozzle plate according to the present invention is equal to or less than $5.0\times10^{14}$ Ω/sq (excluding 0).

As a result of experiments on the present invention nozzle plate satisfying any one of the above (I) to (III), the sheet resistance on the ink discharge surface side of the plate having the configuration in which only the liquid repellent layer (4) was removed from the nozzle plate (hereinafter, this sheet resistance is defined as $R_D$) was equal to or less than ⅔ (except 0) with respect to the sheet resistance $R_A$ on the ink discharge surface side of the nozzle plate.

The measurement sample may be obtained by a method in which a single film of each constituent layer, for example, a water repellent layer, a conductive layer, or an underlayer, is peeled off from the manufactured nozzle plate, and then measuring each constituent layer using each single film, or by forming each constituent layer on a substrate that may be peeled off under the same conditions (composition and layer thickness), then peeling off, and measuring the sheet resistance of the peeled sample by the above method.

The measurement of the sheet resistance may be performed using a substrate obtained by laminating the respective constituent layers before forming the nozzle holes.

The sheet resistance referred to in the present invention may also be obtained by measurement with the four-point probe method according to JIS K7194.

[Each Component Material of Nozzle Plate]

Next, the substrate (2), the liquid repellent layer (4), the conductive layer (3), the adhesion layer (7), and the underlayer (8) constituting the nozzle plate according to the present invention will be described in detail.

(Substrate)

The substrate (2) constituting the nozzle plate may be selected from materials having high mechanical strength, ink resistance, and excellent dimensional stability, for example, stainless steel, nickel (Ni) or other metal materials, polyimide, polyphenylene sulfide, polyethylene terephthalate, or other organic materials may be cited. Further, silicon (Si) may also be used.

In the present invention, it is preferable that the substrate is a non-metallic material, and further, it is preferable that the substrate is made of a resin material such as silicon, polyimide, polyphenylene sulfide, or polyethylene terephthalate.

As a substrate constituting the nozzle plate, a polyimide resin material (for example, UPILEX manufactured by Ube Industries, Ltd.) is excellent in chemical stability, a polyphenylene sulfide resin material (for example, TORELINA manufactured by Toray Corporation) is excellent in dimensional stability, and silicon is excellent in processing accuracy.

The thickness of the substrate is not particularly limited, but is usually within a range of 10 to 200 μm, preferably within a range of 10 to 100 μm, and more preferably within a range of 20 to 100 μm.

(Liquid Repellent Layer)

In the present invention, there is no particular limitation on the liquid repellent layer, but it is preferable that the liquid repellent layer contains a fluorine-based compound, and the fluorine-based compound contains: (1) a compound having a perfluoroalkyl group containing at least an alkoxysilyl group, a phosphonic acid group or a hydroxy group, or a compound having a perfluoropolyether group containing an alkoxysilyl group, a phosphonic acid group or a hydroxy group; or (2) a mixture containing a compound having a perfluoroalkyl group, or a mixture containing a compound having a perfluoropolyether group.

Fluorine-based compounds are also commercially available. Examples thereof are obtained from Toray Dow Corning Silicone Co., Ltd., Shin-Etsu Chemical Co., Ltd., Daikin Industries Co., Ltd. (e.g., OPTOOL DSX), Asahi Glass Co., Ltd. (e.g., CYTOP), SECO Corporation (e.g., Top CleanSafe™), and FLUORO TECHNOLOGY Co., Ltd. (e.g., FLUOROSARF), Gelest Inc. and SOLVAY SOLEXIS Co., Ltd. (e.g., Fluorolink S10). These may be prepared by the synthetic methods or similar methods described in: J. Fluorine Chem., 79(1). 87(1996), Materials Technologies, 16(5), 209 (1998), Collect. Czech. Chem. Commun., 44, 750-755, J. Amer. Chem. Soc., 1990, 112, 2341-2348, Inorg. Chem., 10, 889-892, 1971, U.S. Pat. No. 3,668,233; JP-A 58-122979, JP-A 7-242675, JP-A 9-61605, JP-A 11-29585, JP-A 2000-64348, and J JP-A 2000-144097.

Specific examples of the compound having a silane group-terminated perfluoropolyether group include "OPTOOL DSX" manufactured by Daikin Industries, Ltd., and a compound having a silane group-terminated fluoroalkyl group described above, for example, "FG-5010Z130-0.2" manufactured by FLUOROSURF Co., Ltd. Examples of the polymer having a perfluoroalkyl group include "SF Coat Series" manufactured by AGC Seimi Chemical Co., Ltd., and examples of the polymer having a fluorine-containing heterocyclic structure in the main chain include "CYTOP" manufactured by Asahi Glass Co., Ltd. Further, a mixture of FEP (4 ethylene fluoride-6 propylene fluoride copolymer) dispersion and a polyamideimide resin may be mentioned.

Alternatively, a fluororesin may be applied. Examples thereof that may be used are polytetrafluoroethylene (PTFE), a tetrafluoroethylene-perfluoroalkylvinyl ether copolymer (PFA), a tetrafluoroethylene-hexafluoropropylene copolymer (FEP), a tetrafluoroethylene-ethylene copolymer (ETFE), a polychlorotrifluoroethylene (PCTFE), and a polyvinylidene fluoride (PVDF). FEP has a low critical surface tension and excellent liquid repellency, and is preferred in that it has a low melt viscosity at 300 to 400° C., which is a heat treatment temperature, and a uniform film may be formed.

Examples of the other fluorine-based compound include a hydrolyzable silane compound containing a fluorine group described in JP-A 2017-154055, and an organic fluorine-based compound and a fluorine-containing organometallic compound described in WO 2008/120505.

As a method of forming the liquid repellent layer by the PVD method, it is preferable to use Evaporation substances WR1 and WR4 manufactured by Merck Japan Co., Ltd., which is a fluoroalkylsilane mixed oxide, as a fluorine-based compound, and to previously form a silicon oxide layer as an underlayer or an adhesion layer as a base, for example, when a liquid repellent layer by WR1 is formed on a silicon substrate. The liquid repellent layer formed by WR1 and WR4 exhibits liquid repellency to an organic solvent such as an alcohol including ethanol, ethylene glycol (including polyethylene glycol), a thinner, and a coating material in addition to water.

The layer thickness of the liquid repellent layer according to the present invention is preferably in the range of 1 nm to 3.00 μm, but more preferably 300 nm or less when the nozzle hole is formed by a laser.

(Conductive Layer)

The conductive layer according to the present invention is characterized in that it is a layer composed of a material having current-carrying characteristics.

The conductive layer according to the present invention preferably has a sheet resistance measured by a double ring method in accordance with JIS K 6911, ASTM D257 of $1.0\times10^{10}$ Ω/sq or less, more preferably $5.0\times10^{8}$ Ω/sq or less, and still more preferably $3.0\times10^{4}$ Ω/sq or less (except for 0).

<Sublimable Compound>

As the conductive layer according to the present invention, a first preferable form is that it is formed with a sublimable compound. Further, it may be used a method of: forming a conductive layer using a conductive carbon material or a metal compound as a sublimable compound with a vapor deposition method, for example; or forming a conductive layer containing a resin component having a desired resistance value by using these materials as a fine particle dispersion liquid in a state of fine particles and dispersing them in a resin material (for example, a thermosetting resin, a thermoplastic resin, or an active energy ray-curable resin).

Specific examples of carbon materials applicable to forming the conductive layer according to the present invention include fullerenes (e.g., fullerene C60, fullerene C70, fullerene C76, fullerene C78, fullerene C84, fullerene C240, fullerene C540, mixed fullerenes, fullerene nanotubes, multilayered nanotubes, single-walled nanotubes, nanohorns (conical), graphenes, carbon nanotubes, and amorphous carbons (amorphous carbons including at least one element of glassy carbon, Si, O, H; diamond-like carbon, hydrogen-free diamond-like carbon).

Further, as the metal compound applicable to the formation of the conductive layer according to the present invention, a metal oxide is preferably used. Examples thereof include ITO (tin-doped indium oxide), ZnO, $Nb_2O_5$, ZnO/$Sb_2O$ (zinc antimonate), $ZrO_2$, $CeO_2$, $Ta_2O_5$, $TiO_2$, $T_3O_5$, $T_4O_7$, $T_2O_3$, TiO, $SnO_2$, $La_2Ti_2O_7$, IZO (indium zinc oxide), AZO (aluminum-doped zinc oxide), GZO (gallium-doped zinc oxide), ATO (antimony tin oxide), ICO (indium cerium oxide), $Bi_2O_3$, a-GIO, $Ga_2O_3$, $GeO_2$, $SiO_2$, $Al_2O_3$, $HfO_2$, SiO, MgO, $Y_2O_3$, $WO_3$, a-GIO (gallium indium oxide), and IGZO (indium-gallium-zinc oxide).

In the present invention, a particularly preferable sublimable compound is a tin-doped indium oxide or a carbon material.

<Organic Conductive Polymer>

In the second preferable form, the conductive layer according to the present invention is formed of an organic conductive polymer.

As an organic conductive polymer applicable to the present invention, it may be a material which itself functions as a binder and forms a conductive resin layer, or it may be used a method of forming conductive resin fine particles by a conductive polymer compound and adding it in a dispersed state (resin emulsion) into an existing resin material to form a conductive resin layer.

Examples of the organic conductive polymer applicable to the present invention include chain-like conductive polymers such as polypyrroles, polyindoles, polycarbazoles, polythiophenes, polyanilines, polyacetylenes, polyfurans, polyparaphenylenevinylenes, polyazulenes, polyparaphenylenes, polyparaphenylenesulfides, polyisothianaphthenes, polythiazils, and polyacene-based conductive polymers. In the present invention, it is particularly preferable that the polymer is at least one cationic n-conjugated conductive polymer selected from polythiophenes, polyanilines, and polypyrroles.

In the present invention, a commercially available polymer may also be preferably used as an organic conductive polymer.

For example, as a polymer compound containing PEDOT (poly(3,4-ethylenedioxythiophene)), a conductive polymer compound composed of poly(3,4-ethylenedioxythiophene) and polystyrene sulfonic acid (abbreviated as PEDOT/PSS) may be mentioned. For example, CLEVIOS series from Heraeus Co., Ltd., ORGACON series from Agfa Materials Japan, Denatron P-502RG, Denatron PT-432ME from Nagase Chemtex Co., Ltd., SEPLEGYDAR AS-X, SEPLEGYDAR AS-D, SEPLEGYDAR AS-H, SEPLEGYDAR AS-F, SEPLEGYDAR HC-R, SEPLEGYDAR HC-A, SEPLEGYDAR SAS-P, SEPLEGYDAR SAS-M from Shin-Etsu Polymer Co., Ltd., PEDOT/PSS 483095, 560596 from Aldrich are commercially available. Polyanilines are sold as the ORMECON series by Nissan Chemical Industries, Ltd., for example. Further, polypyrroles are commercially available as 482552 and 735817 from Aldrich Co., Ltd. for example. In the present invention, the above-mentioned commercially available products may be preferably used as the organic conductive polymer.

In addition, as a commercial product of a thermosetting type organic conductive polymer, ST poly (manufactured by Achilles Corporation), Conductive coating S-983, Conductive coating S-495, Conductive coating S-948, and Conductive coating R-801 (manufactured by Chukyo Yushi Co., Ltd.), SEPLEGYDAR OC-AE, SEPLEGYDAR AS-H03Q (manufactured by Shin-Etsu Polymer Co., Ltd.), and a BEAMSET E-2 (manufactured by Arakawa Chemical Co., Ltd.) may be used.

As a commercially available product of a photocurable organic conductive polymer, Conductive coating R-986, Conductive coating UVS-542 (manufactured by Chukyo Yushi Co., Ltd.), SEPLEGYDAR OC-X, SEPLEGYDAR OC-U, SEPLEGYDAR OC-X (manufactured by Shin-Etsu Polymer Co., Ltd.), BEAMSET 1700CP, BEAMSET 1800CP, and BEAMSET E-1 (manufactured by Arakawa Chemical Co., Ltd.) may be used.

For details of the conductive layer forming material, for example, the content described in paragraphs (0045) to (0151) of JP-A 2016-126954 may be referred to.

The thickness of the conductive layer is preferably in the range of 1 nm to 3.00 μm, and of these, it is preferably in the range of 5 to 500 nm.

(Underlayer)

As the underlayer according to the present invention, the first configuration is the case where the substrate is made of a non-metallic material. It is preferable that the underlayer contains one or more kinds of metal element selected from tantalum, zirconium, hafnium, niobium, titanium, tungsten, cobalt, molybdenum, lanthanum, manganese, chromium, yttrium, praseodymium, ruthenium, rhodium, iridium, cerium and aluminum, and further contains one or more kinds of elements selected from oxygen, nitrogen and carbon.

In addition, the second configuration is the case where the substrate is made of a non-metallic material. It is preferable that the underlayer contains a compound selected from silicon oxide, oxidized silicon carbide, tantalum silicate, and carbonized silicon oxide.

Further, the third configuration is the case where the substrate is made of a resin material. It is preferable that the underlayer is made of polyamide or isocyanate.

The thickness of the underlayer is preferably within a range of 0.5 nm to 1 μm, but among them, it is preferably in a range of 1 to 50 nm.

(Adhesion Layer)

As the adhesion layer according to the present invention, it is preferable to be made of at least an oxide of tantalum, zirconium, hafnium, titanium, ruthenium, rhodium, rhenium, iridium, aluminum, silicon, and carbon. As with silicon oxide, an oxide of one of these elements may be used, or an oxide in which two or more of these elements are bonded, such as tantalum silicate.

The thickness of the adhesion layer is preferably within a range of 0.5 nm to 1 μm, but among them, it is preferably within a range of 1 to 50 nm.

(Method of Forming Each Constituent Layer)

As a method of forming the liquid repellent layer (4), the conductive layer (3), the adhesion layer (7) and the underlayer (8) described above, a thin film forming method such as a wet method or a dry method may be appropriately selected in accordance with the characteristics of the material used for film forming.

As a method for forming each constituent layer, for example, as a wet method, spray coating, spin coating, brush coating, dip coating, or wire bar coating may be used.

Further, as a dry method (generic term of the vacuum film forming method), the following may be cited: (1) physical vapor deposition (PVD): resistance heating type vacuum deposition, electron beam heating type vacuum deposition, ion plating method, ion beam assisted vacuum deposition, and sputtering method; and (2) chemical vapor deposition (CVD): plasma CVD, thermal CVD, organometallic CVD, and photo CVD.

[Method of Manufacturing Nozzle Plate]

Next, a typical method of manufacturing a nozzle plate will be described with reference to FIG. 6 and FIG. 7.

(Nozzle Plate Manufacturing Method A)

Figure 6:
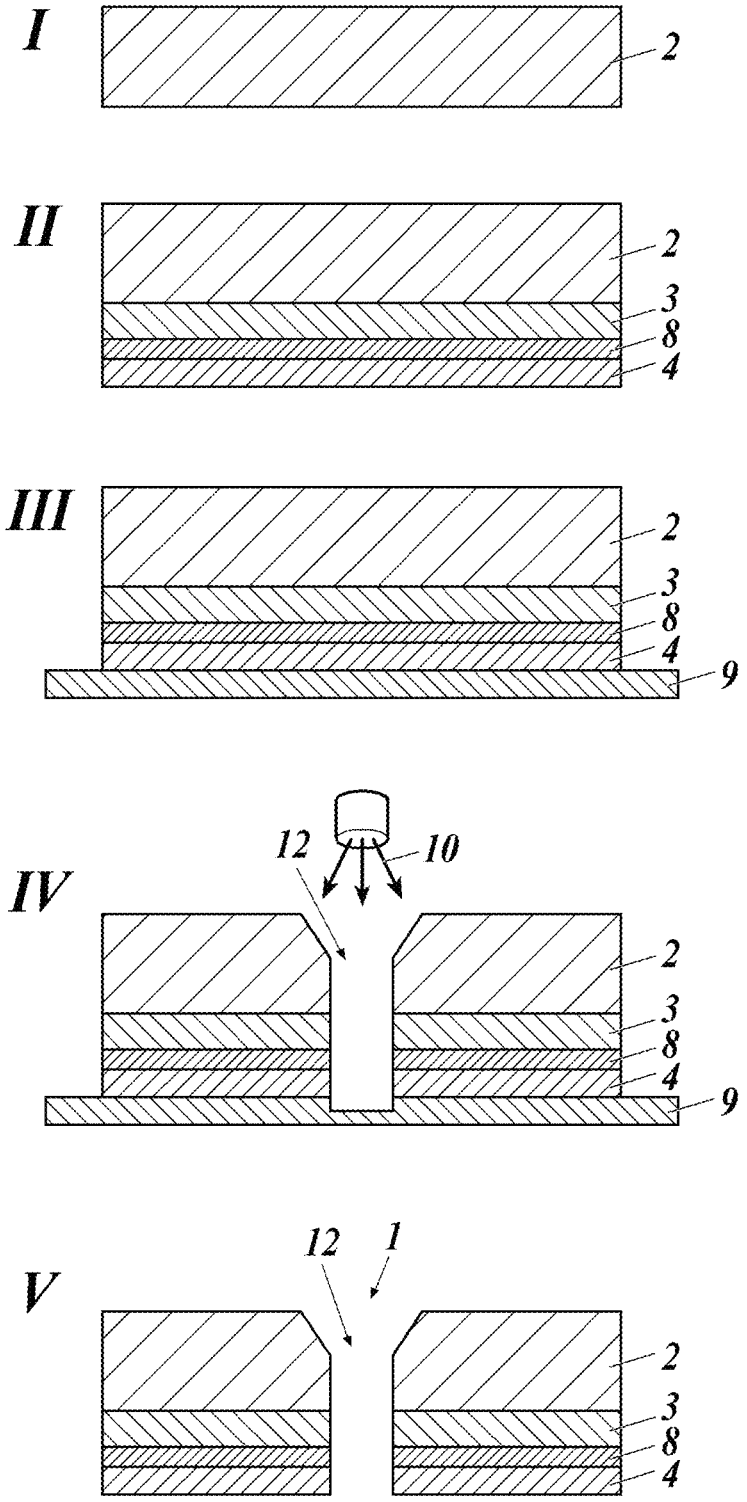
FIG. 6 is a process flow diagram showing an example of a manufacturing process of the nozzle plate according to the present invention

FIG. 6 is a process flow diagram showing an example of the manufacturing process of a nozzle plate according to the present invention. In FIG. 6, the nozzle plate according to an embodiment 3 described with reference to FIG. 3 may be manufactured through the following steps. In the manufacturing method A of the nozzle plate, lamination is performed by using each unprocessed component member in which the nozzle hole is not formed, and finally the nozzle through hole (12) is formed.

<Step A1>

The substrate (2) for the nozzle plate is prepared as shown in (I) in FIG. 6. As a material of the substrate, an organic resin material such as polyimide (abbreviation: PI), polyphenylene sulfide (abbreviation: PPS), or polyethylene terephthalate (abbreviation: PET); or an inorganic resin material such as silicon (Si) may be used as described above, but in the manufacturing method A, particularly, polyimide (abbreviation: PI) is preferably used.

<Step A2>

Next, as shown in (II) of FIG. 6, a conductive layer (3), an underlayer (8), and a liquid repellent layer (4) are sequentially formed adjacent to the substrate (2) so as to have the configuration shown in FIG. 3.

The method of forming each layer is not particularly limited, and a wet forming method such as spray coating, spin coating, brush coating, dip coating, wire bar coating, inkjet printing, or a dry forming method such as a physical vapor deposition method (PVD, e.g., resistance heating vacuum deposition, electron beam heating vacuum deposition, ion plating, ion beam assisted vacuum deposition, sputtering), a chemical vapor deposition method (CVD, e.g., plasma CVD, thermal CVD, organometallic CVD, or photo CVD) or a chemical vapor deposition method (CVD, e.g., photo CVD) may be appropriately selected in accordance with the characteristics and the purpose of forming each layer. In addition, a different formation method may be applied to each of the constituent layers.

<Step A3>

Step A3 is a step of attaching a protective sheet (9) to the liquid repellent layer (4) surface formed as shown in (III) in FIG. 6. As the protective sheet (9), a configuration having an adhesion layer on its surface is preferred, and the protective sheet (9) and the liquid repellent layer (4) surface are adhered and bonded via an adhesion layer.

As the protective sheet (9), for example, polyethylene terephthalate (abbreviation: PET) is used.

The total thickness of the pressure-sensitive adhesive described below and the protective sheet (9) is preferably in the range of 50 to 300 μm, and more preferably in the range of 100 to 200 μm. Further, the protective sheet (9) is not limited to one sheet, and may be formed by laminating a plurality of sheet materials so as to have a desired thickness.

It is preferable that the protective sheet (9) has a larger area than the substrate (2) of the nozzle plate, and has a tag portion protruding from the substrate (2) of the nozzle plate in a state of being attached to the unit including the substrate (2) constituting the nozzle plate.

If it has a tag portion, since the work may be performed by grasping the tag portion in each subsequent step, dirt on the side without the protective sheet (9) of the nozzle plate may be reduced. In addition, when the protective sheet (9) is finally peeled off, the tag portion may be grasped and peeled off easily.

When a protective sheet (9) having an adhesion layer is used, it is preferable that the protective sheet is a protective sheet with a pressure-sensitive adhesive whose adhesive force is lowered by ultraviolet light irradiation. When the protective sheet (9) is peeled off in Step A5 which is a subsequent step, the pressure-sensitive adhesive force of the pressure-sensitive adhesive is reduced by irradiating the protective sheet (9) with ultraviolet light, and easily, only the protective sheet (9) having the pressure-sensitive adhesion layer may be peeled off, and thus the workability is improved. Further, it is possible to prevent the adhesive remaining on the liquid repellent layer (4) and the liquid repellent layer (4) from peeling off. As the pressure-sensitive adhesive, a rubber-based pressure-sensitive adhesive is preferably used.

<Step A4>

As shown in (IV) of FIG. 6, it is preferable to form a nozzle through hole (12) including a nozzle hole having a predetermined shape pattern on the nozzle plate with the protective sheet (9) manufactured in step A3, for example, by using a laser beam irradiation device (10) from the substrate (2) side.

As the laser to be irradiated from the side of the substrate (2), an excimer laser, a carbon dioxide laser, or a YAG laser is exemplified, and in particular, or an ultraviolet laser such as an excimer laser is preferable. By using a high-power ultraviolet laser such as an excimer laser, it is also possible to perform processing called ablation processing, in which a bond of molecule is cut and a substance is vaporized and removed, so that it is possible to perform processing of a nozzle hole of high quality without heat influence on the periphery of the nozzle.

The excimer laser is able to output ultraviolet light with short pulses (about 20 ns) and high brightness (about tens of MW). Although the oscillating wavelength varies depending on the type of laser gas, it is XeCl (wavelength 308 nm) and KrF (wavelength 248 nm) that are often used for ablation.

In the step of forming the nozzle through hole (12) in the step A4, it is important that the ink hole (12) to be formed is not allowed to pass through the protective sheet (12) in consideration of the workability in the peeling process of the protective sheet (9) in the next step.

By forming a nozzle hole using an excimer laser, the nozzle plate (1) may be manufactured by forming, for example, 256 nozzle holes per one nozzle plate so that the diameter of the nozzle hole (5) on the ink ejection side becomes, for example, 5 to 50 μm.

Further, as a method of forming the other nozzle through holes (12), for example, an anisotropic etching method of alternately repeating the etching and deposition described in JP-A 2009-148924, JP-A 2009-286036, and JP-A 2009-298024, may be used.

<Step A5>

According to the above method, the protective sheet (9) is peeled off from the nozzle plate with the protective sheet (9) in which the nozzle through holes (12) and the nozzle holes (5) are formed, and the nozzle plate (1) shown in (V) of FIG. 6 is produced.

(Nozzle Plate Manufacturing Method B)

Figure 7:
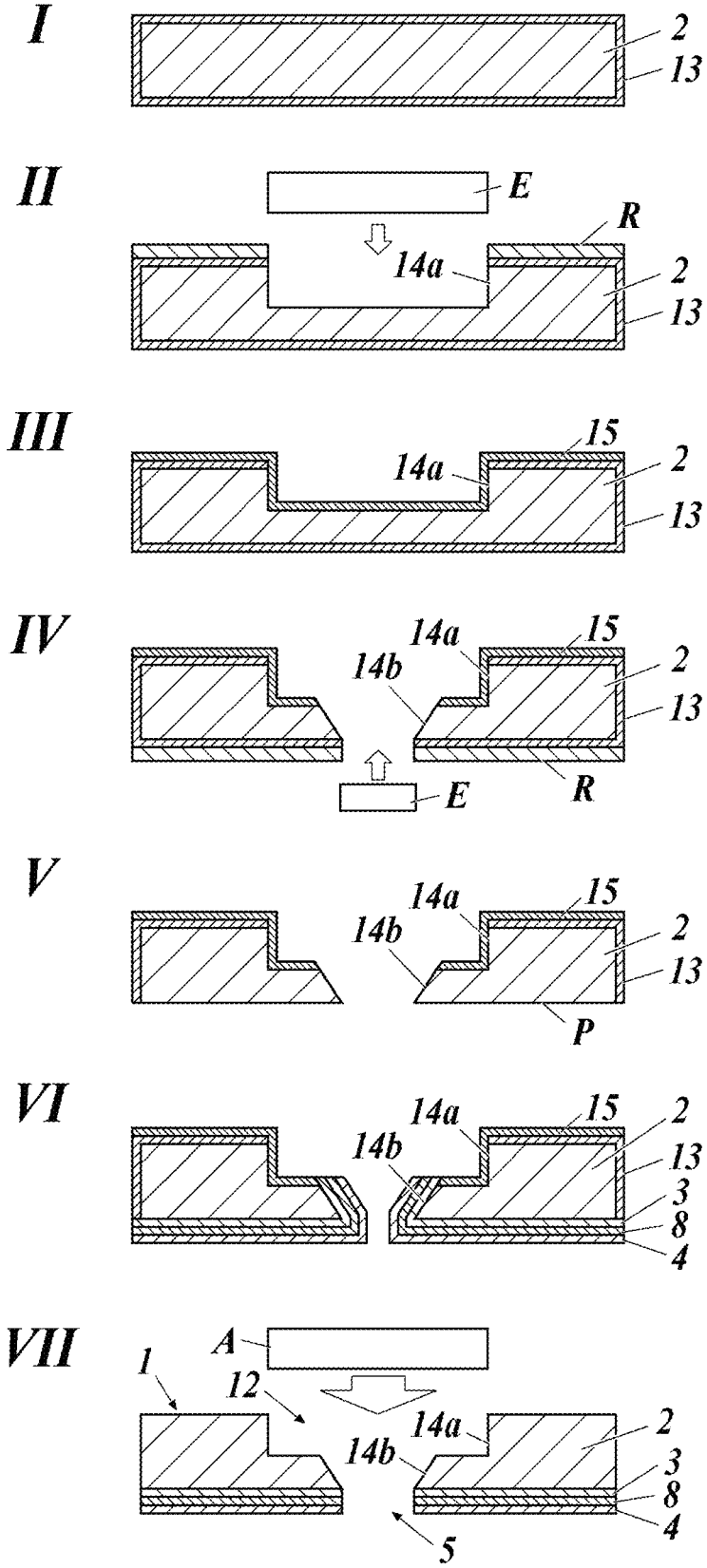
FIG. 7 is a process flow diagram illustrating another example of a process for manufacturing a nozzle plate according to the present invention

FIG. 7 is a process flow diagram showing another example of the manufacturing process of the nozzle plate according to the present invention. In FIG. 7, the nozzle plate according to an embodiment 3 described with reference to FIG. 3 may be manufactured through the following steps. In the manufacturing method B of the nozzle plate, of the constituent materials, the nozzle through holes are formed in the substrate, then the constituent layers are laminated, and finally, the constituent materials existing in the nozzle through holes are removed again to form the nozzle through holes (12).

<Step B1>

As shown in (I) of FIG. 7, a flat substrate (material of a substrate for discharge) (2) is formed of a silicon material, a polyimide resin material, or another organic material. For example, a flat silicon substrate (2) having a thickness of about 250 μm is prepared.

Next, for example, a substrate (2) made of a silicon material is subjected to a thermal oxidation treatment to form an oxide layer (13, a silicon oxide film) on the entire surface (first step). The thickness of the oxide layer (13) is, for example, in the range of 30 to 200 nm.

<Step B2>

Next, as shown in (II) of FIG. 7, a resist pattern (R) is formed on the upper surface of the substrate (2), and dry etching (E) is performed from the upper surface of the substrate (2) by a Deep-RIE (Reactive Ion Etching) apparatus using a Bosch method to form a liquid flow path (14*a*) (second step). The opening cross-section of the liquid flow path (14*a*) is circular, the inner diameter is, for example, in the range of 200 to 400 μm, and the height is, for example, in the range of 100 to 200 μm.

<Step B3>

Next, as shown in (III) of FIG. 7, in order to protect the inner surface of the liquid flow path (14*a*), for example, a silicon oxide film (15) is formed on the liquid flow path (14*a*), the bottom surface portion, and the upper surface (on the oxide layer (13)) by the CVD method (third step).

<Step B4>

Next, as shown in (IV) in FIG. 7, a resist pattern (R) is formed on the lower surface of the substrate (2), and dry etching (E) is performed from the lower surface by a Deep-RIE apparatus using a Bosch method. By making the silicon oxide film (15) as a stopper layer, a nozzle (14*b*) is formed (fourth step). Note that the substrate (2) may be an SOI (Silicon on Insulator) substrate, and an intermediate layer thereof may be used as a stopper layer. The opening cross-section of the nozzle (14*b*) is circular, the inner diameter is, for example, in the range of 15 to 30 μm, and the height (length) is, for example, in the range of 10 to 50 μm. The nozzle (14*b*) may also be formed by laser processing on the substrate (2).

<Step B5>

Next, as shown in (V) of FIG. 7, after removing the resist pattern (R), the oxide layer (13) on the ink discharge surface (P) is removed by dry etching (fifth step).

<Step B6>

Next, as shown in (VI) of FIG. 7, a conductive layer (3), an underlayer (8), and a liquid repellent layer (4) are sequentially formed on the ink discharge surface (P).

The method of forming each layer is not particularly limited, and a wet forming method such as spray coating, spin coating, brush coating, dip coating, wire bar coating, and inkjet printing, or a dry forming method such as a physical vapor deposition method (PVD, e.g., resistance heating vacuum deposition, electron beam heating vacuum deposition, ion plating, ion beam assisted vacuum deposition, or sputtering), a chemical vapor deposition method (CVD, e.g., plasma CVD, thermal CVD, organometallic CVD, or photo CVD), or a chemical vapor deposition method (CVD, e.g., photo CVD) may be appropriately selected in accordance with the characteristics and the purpose of forming each layer. In addition, a different formation method may be applied to each of the constituent layers.

<Step B7>

Next, as shown in (VII) of FIG. 7, the conductive layer (3), the underlayer (8) and the liquid repellent layer (4), the silicon oxide film (15) and the oxide layer (13) formed on the nozzle (14*b*) are removed by ashing (A), or UV irradiation, thereby manufacturing the nozzle plate (1) (seventh step).

<<Inkjet Head>>

Figure 8:
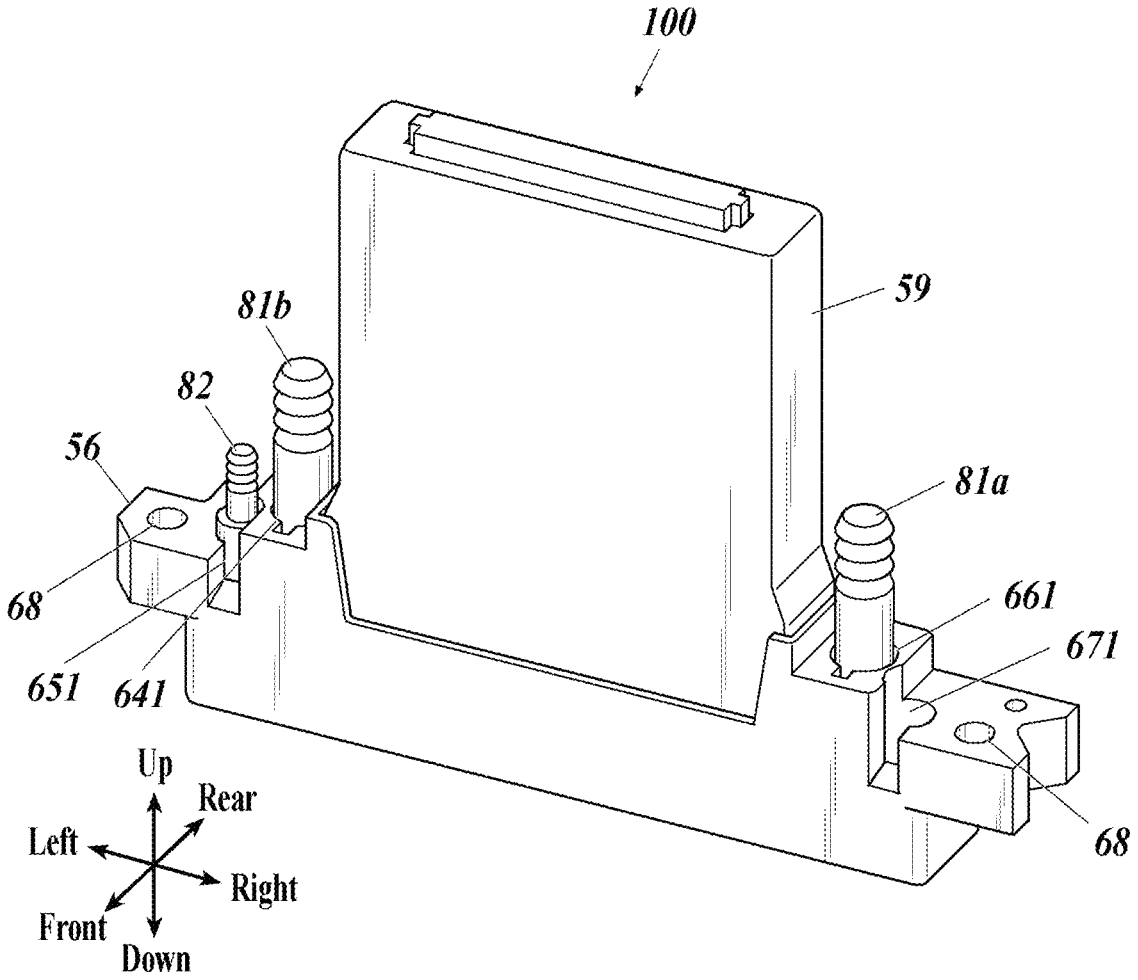
FIG. 8 is a schematic perspective view showing an example of the structure of an inkjet head to which the nozzle plate according to the present invention may be applied.

FIG. 8 is a schematic external view showing an example of the structure of an inkjet head to which the nozzle plate of the present invention may be applied. Further, FIG. 9 is a bottom view of an inkjet head.

As shown in FIG. 8, the inkjet head (100) of the present invention is intended to be mounted on an inkjet printer (not shown). The inkjet head is provided with a head chip for ejecting ink from the nozzle, a wiring board in which the head chip is disposed, a drive circuit board connected through the flexible substrate, a manifold for introducing ink through a filter to the channel of the head chip, a housing (56) in which the manifold is housed, a cap receiving plate (57) mounted so as to close the bottom opening of the housing (56), first and second joints (81*a*, 81*b*) attached to the first ink port and the second ink port of the manifold, a third joint (82) attached to the third ink port of the manifold, and a cover member (59) attached to the housing (56). Further, mounting holes (68) for mounting the housing (56) on the printer main body side are respectively formed.

Figure 9:
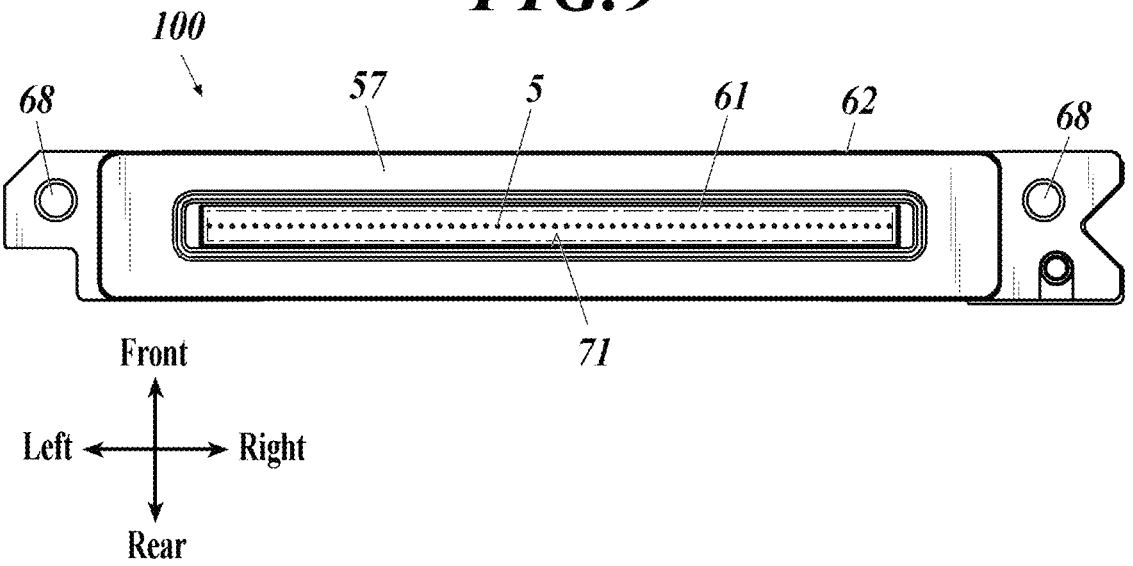
FIG. 9 is a bottom view showing an example of a nozzle plate constituting the inkjet head shown in FIG. 8.

Further, the cap receiving plate (57) shown in FIG. 9 is formed in a substantially rectangular plate shape having an outer shape elongated in the left-right direction in correspondence with the shape of the cap receiving plate attachment portion (62), and is formed in a substantially central portion thereof. In order to expose the nozzle plate (61) on which the plurality of nozzle holes (5) are arranged, an elongated nozzle opening (71) is provided in the left-right direction. Further, with respect to the specific structure of the inside of the inkjet head shown in FIG. 9, for example, it is possible to refer to FIG. 2 described in JP-A 2012-140017.

Although a typical example of an inkjet head is shown in FIG. 8 and FIG. 9, an inkjet head having a configuration described in, for example, JP-A 2012-140017, JP-A 2013-010227, JP-A 2014-058171, JP-A 2014-097644, JP-A 2015-142979, JP-A 2015-142980, JP-A 2016-002675, JP-A 2016-107401, JP-A 2017-109476, and JP-A 2017-177626 may be appropriately selected and applied.

<<Inkjet Ink>>

There is no particular limitation on the inkjet ink applicable to the image forming method of the present invention, and for example, there are various types of inkjet inks, such as an aqueous inkjet ink containing water as a main solvent, an oil-based inkjet ink containing a nonvolatile solvent not volatilized at room temperature and substantially free of water, an organic solvent-based inkjet ink containing a solvent volatilized at room temperature and substantially free of water, a hot melt ink which is printed by heating and melting a solid ink at room temperature, and an active energy ray-curable inkjet ink which is cured by an active ray such as ultraviolet rays after printing.

Further, it is classified into dye ink, or pigment ink depending on the type of coloring material to be applied.

In the image forming method of the present invention, it is a preferred embodiment in which the inkjet ink to be applied is an inkjet ink containing 40% by mass or more of a hydrocarbon having an ether group or a hydroxy group as a solvent based on the total mass of the ink.

As the hydrocarbons having an ether group or a hydroxy group in the present invention, alcohols, polyhydric alcohols and polyhydric alcohol ethers are preferable. Examples thereof are: alcohols (for example, methanol, ethanol, propanol, isopropanol, butanol, isobutanol, secondary butanol, and tertiary butanol); polyhydric alcohols (for example, ethylene glycol, diethylene glycol, propylene glycol, dipropylene glycol, butylene glycol, hexanediol, glycerin, hexanetriol, and thiodiglycol); polyhydric alcohol ethers (for example, ethylene glycol monomethyl ether, ethylene glycol monobutyl ether, diethylene glycol monomethyl ether, diethylene glycol monoethyl ether, diethylene glycol monobutyl ether, Propylene Glycol monomethyl ether, propylene glycol monobutyl ether, ethylene glycol monomethyl ether acetate, triethylene glycol monomethyl ether, triethylene glycol monobutyl ether, ethylene glycol monophenyl ether, and propylene glycol monophenyl ether).

EXAMPLES

Hereinafter, the present invention will be specifically described by way of Examples, but the present invention is not limited thereto. In the examples, "parts" or "%" is used, but unless otherwise specified, it indicates "parts by mass" or "% by mass". Each operation was performed at room temperature (25° C.) unless otherwise specified.

Example 1

<<Preparation of Nozzle Plate>

[Preparation of Nozzle Plate 1]

According to the manufacturing flow of the nozzle plate described in FIG. 6 (Manufacturing method A), a nozzle plate 1 made of the configuration described in FIG. 3 was prepared.

(1) Preparation of Substrate

As a substrate (2), a polyimide sheet (abbreviation: PI, UPILEX manufactured by Ube Industries, Ltd.) having a thickness of 75 μm was prepared.

(2) Formation of Conductive Layer

A conductive layer (3) composed of amorphous carbon and having a layer thickness of 20 nm was formed on the substrate (2) prepared above by sputtering using a carbon target.

(3) Formation of Underlayer

Next, adjacent to the formed conductive layer (3), by using a film forming gas containing an alkyl silicon compound (abbreviation: TMS, tetramethylsilane, $Si(CH_3)_4$) as an underlayer forming material, and an additive gas using carbon dioxide and argon as an inert gas, vapor deposition was performed by a known plasma CVD method to form an underlayer (8) composed of carbonized silicon oxide and having a layer thickness of 5 nm.

(4) Formation of Liquid Repellent Layer

Then, adjacent to the above-formed underlayer (8), a fluorine-based compound 1 (OPTOOL DSX manufactured by Daikin Industries, Ltd., a silane group-terminated perfluoropolyether compound) was used as a liquid repellent layer forming material and a liquid repellent layer (4) having a layer thickness of 5 nm was formed by spray coating.

(5) Provision of Protective Sheet

A polyethylene terephthalate film having a thickness of 100 μm having a pressure-sensitive adhesion layer composed of a rubber-based pressure-sensitive adhesive on one surface side was prepared as a protective sheet (9). Then, the liquid repellent layer (4) of the nozzle plate and the adhesion layer of the protective sheet (9) were bonded to each other so as to face each other, and the configuration described in (III) of FIG. 6 was formed.

(6) Preparation of Nozzle Through Hole and Nozzle Hole

For the nozzle plate having a protective sheet prepared above, the excimer laser (10, oscillation wavelength: 248 nm, pulse width: 150 nsec) was irradiated from the substrate (2) surface side as shown in (IV) in FIG. 6. Thus, four rows of 256 nozzles having a diameter of 40 μm, a taper angle of 30°, and a nozzle through hole of 50 μm and having the shape shown in FIG. 3 were formed.

Finally, the protective sheet was peeled off to produce a nozzle plate 1.

[Preparation of Nozzle Plate 2]

In the preparation of the nozzle plate 1 described above, the nozzle plate 2 having the structure shown in FIG. 3 was produced in the same manner except that the conductive layer (2) was not formed.

Specifically, a polyimide sheet having a thickness of 75 μm (abbreviation PI, UPILEX manufactured by Ube Industries, Ltd.) was prepared. By using a similar method used for preparation of the nozzle plate 1, an underlayer (8) having a thickness of 5 nm made of carbonized silicon oxide and a liquid repellent layer (4) having a thickness of 5 nm using the fluorine-based compound 1 were formed on the substrate (2). Then, the nozzles similar to the nozzle plate 1 were formed to produce the nozzle plate 2 having the configuration shown in FIG. 3. The nozzle plate 2 having no conductive layer (3) is a comparative example to the nozzle plate 1 of the present invention.

<<Evaluation of Nozzle Plate>>

[Measurement of Sheet Resistance]

With respect to the nozzle plates 1 and 2 thus produced, multilayered films having the same conditions (base materials, compositions, and layer thicknesses) as those of the respective nozzle plates of 100 mm×100 mm were separately produced, and they were measured by a double ring method conforming to JIS K 6911 and ASTM D257 to obtain sheet resistances.

Specifically, the measurement was performed using a super-insulating meter SM7110 with an electrode SME-8310 for a flat plate sample (above, manufactured by HIOKI E.E. Corporation).

The electrode was evaluated after 1 minute under a voltage of 500 V with a diameter of the main electrode of 5 cm and an inner diameter of the guard electrode of 7 cm, and the same evaluation was performed three times on the same sample to obtain an average, and a value obtained by multiplying the average by 18.850 was used as the sheet resistance. If not measured by the above voltage, it was measured similarly at 0.1 V voltage.

[Determination of Sheet Resistance]

Next, among the produced nozzle plates, the following sheet resistance determination was performed with reference to the nozzle plate 1 having the conductive layer and the liquid repellent layer according to the present invention. Specifically, when the sheet resistance on the ink discharge surface side of the nozzle plate 1 having the conductive layer was not more than ⅔ (but not including 0) of the sheet resistance on the liquid repellent layer side of the nozzle plate 2 having the configuration in which only the conductive layer was removed from the nozzle plate 1, or when the sheet resistance on the ink discharge surface side of the nozzle plate 1 was equal to or less than $5.0\times10^{14}$ Ω/sq (but not including 0), it was determined as "AA", and when neither of the above levels was satisfied, it was determined as "BB".

Table I shows the results of sheet resistance measurements and sheet resistance determination of the nozzle plates 1 and 2. The sheet resistance determination of the nozzle plate 2 having no conductive layer was described as "ref." because it is a comparative example.

[Evaluation of Wipe Resistance]

As an accelerated test of nozzle wipe maintenance performed when an inkjet head was mounted on an inkjet printer, wiping was repeated 200 times with a load of 40 kPa using cellulose fibers, and the wipe resistance was evaluated according to the following criteria. The liquid repellency referred to in the present invention refers to a case where the contact angle when the ink is dropped on the nozzle plate is 60 degrees or more.

AA: The liquid repellency and external appearance of the nozzle plate do not change.

BB: Both the liquid repellency and the appearance of the nozzle plate deteriorate, and the nozzle plate is of a quality that cannot withstand practical use.

[Evaluation of Ink Immersion Resistance]

Each of the above-prepared nozzle plates was immersed in an aqueous alkaline dummy ink of black ink and having pH 11 shown below for 4 weeks, respectively. Then they were evaluated according to the following criteria for whether or not the liquid repellency was maintained. The liquid repellency referred to in the present invention refers to a case where the contact angle when the black ink is dropped onto the nozzle plate is 60 degrees or more.

(Preparation of Black Ink 1)

An ink for evaluation having the following configuration was prepared.

<Preparation of Black Pigment Dispersion>

C.I. Pigment Black 6: 12 g

PB822 (made by Ajinomoto Fine-Tech): 5 g

Isopropyl methyl sulfone: 5 g

Triethylene glycol monobutyl ether: 68 g

Ethylene glycol diacetate: 10 g

The above components were mixed and dispersed by a horizontal bead mill in which 0.3 mm zirconia beads were filled with 60% by volume to obtain a black pigment dispersion. The average particle size was 125 nm.

(Preparation of Ink)

Black pigment dispersion: 33 g

Ethylene glycol monobutyl ether: 57 g

Triethylene glycol monomethyl ether acetate: 6.7 g

N-methyl-2-pyrrolidone: 3.3 g (Preparation of Aqueous Alkaline Dummy Ink Having pH 11)

In the aqueous alkaline dummy ink having pH 11, a buffer solution such as sodium carbonate or potassium carbonate was mixed and adjusted to a pH value of 10 to 11. This dummy ink is an aqueous solution containing propylene glycol alkyl ether, dipropylene glycol alkyl ether, and tripropylene glycol alkyl ether.

AA: There is no change in liquid repellency for both inks.

BB: No change in liquid repellency with respect to at least one ink.

CC: The liquid repellency is slightly deteriorated for both inks, but the quality is practically acceptable.

DD: The liquid repellency is obviously deteriorated for both inks, and the quality is not for practical use.

<<Preparation of Inkjet Head>>

Inkjet heads 1 and 2 were manufactured in the same manner as preparation of an inkjet head KM1024i manufactured by Konica Minolta Inc. except that the nozzle plates 1 and 2 were provided instead of the nozzle plate provided with the inkjet head KM1024i.

[Evaluation of Ejection Stability]

The black ink prepared by the "evaluation of ink immersion resistance" was continuously ejected for 4 hours using each of the above-manufactured inkjet heads. Thereafter, the ejection stability was evaluated by synchronizing the ejection cycle and the light emission cycle with each other and monitoring the flight state of each ink by a CCD camera using the ink droplet flight observation apparatus of the stroboscopic light emission system described in FIG. 2 of JP-A 2002-363469 to confirm that ink drops were normally ejected from all nozzles (1024 pieces), that there were no oblique ejection, and that there were no speed variations.

In the evaluation of the ejection stability, both the inkjet head 1 and the inkjet head 2 showed good results. That is, it was confirmed that the carbon conductive layer did not affect the nozzle hole formation by laser processing.

[Evaluation of Nozzle Plate Surface Potential]

As a dummy ink, 10 ml of triethylene glycol monobutyl ether was introduced from the inlet of the inkjet head over 10 seconds, and after pushing out from the nozzle, the ink on the nozzle surface was wiped off, and the potential of the surface of the nozzle plate was measured 25 seconds after the start of the ink introduction (15 seconds after the end of the ink introduction) and 1 minute later using a surface electrometer (Digital Electrostatic Potential Measurement KSD-2000 Kasuga Denki, Inc.). This humidity measurement was performed under low temperature and low humidity conditions of 10±3° C. and 20±5% RH, which are environments in which charges are harder to escape than normal temperature and normal humidity.

[Evaluation of Ink Adhesion Resistance]

Similar to the "evaluation of ejection stability" described above, while continuously ejecting the black ink prepared above for up to 100 minutes, the adhesion state of the ink mist on the surface of the nozzle plate constituting each inkjet head was visually observed, and the ink adhesion resistance was evaluated according to the following criteria.

AA: No adhesion of ink mist was observed at 100 minutes on the nozzle plate surface and near the nozzle at the time of 100 minutes.

BB: Adhesion of ink mist is observed on the surface of the nozzle plate and near the nozzle at the time of 30 minutes.

CC: Adhesion of ink mist is observed at the nozzle plate surface and near the nozzle at the time of 10 minutes.

The evaluation results obtained by the above are shown in Table I. As for the evaluation of ejection stability, both plates gave good results as described above, and the description in Table I was omitted.

TABLE I

| Nozzle plate and Inkjet head No. | | 1 | 2 |
|---|---|---|---|
| Configuration of nozzle plate | Substrate (2) | Polyimide | Polyimide |
| | Adhesion layer (7) | — | — |
| | Conductive layer (3) | Carbon | — |
| | Under layer (8) | Carbonized silicon oxide | Carbonized silicon oxide |
| | Liquid repellent layer (4) | Fluorine-based compound 1 *A | Fluorine-based compound 1 *A |
| Sheet resistance (Ω/sq.) | | $2.10 \times 10^{14}$ | $7.20 \times 10^{14}$ |
| Determination of sheet resistance | | AA | ref. |
| Wipe resistance | | AA | AA |
| Ink immersion resistance | | AA | AA |
| Nozzle plate surface potential (kV) | After 25 seconds | 0.00 | −0.05 |
| | After 1 minute | 0.00 | −0.01 |
| Ink adhesion resistance | | AA | BB |
| Remarks | | Present Invention | Comparative Example |

*A: Silane group-terminated perfluoropolyether group compound

As described in Table I, the sheet resistance of the nozzle plate 1 having the conductive layer on the ink discharge surface side was $2.10\times10^{14}$ Ω/sq, and the sheet resistance was in the range of $5.00\times10^{14}$ Ω/sq or less. This sheet resistance was 0.29 times (i.e., ⅔ or less) of the sheet resistance of $7.20\times10^{14}$ Ω/sq on the ink discharge surface of the nozzle plate 2 having the configuration in which only the conductive layer was removed from the nozzle plate 1. That is, it was shown that the introduction of the conductive layer into the nozzle plate, which is the method of the present invention, has the effect of reducing the sheet resistance on the ink discharge surface side of the nozzle plate.

As described in Table I, both nozzle plate 1 and nozzle plate 2 were found to have good wipe resistance and ink immersion resistance. That is, it was confirmed that the carbon conductive layer had no influence on both resistances.

As described in Table I, the surface potential of the nozzle plate after the ink extrusion was 0.00 kV after 25 seconds with the inkjet head 1, and it was −0.01 kV even after 1 minute with the inkjet head 2 as a comparative example. This is presumed to be because, in the inkjet head 1, the negative charge generated in the nozzle plate by ink extrusion rapidly moves to the outside of the nozzle plate due to the effect of the conductive layer satisfying the sheet resistance determination, whereas in the inkjet head 2 having no conductive layer, the charge continues to remain on the nozzle plate surface.

Next, with respect to the results of the ink adhesion resistance described in Table I, although the ink mist did not adhere to the nozzle plate even after the inkjet head 1 was continuously ejected for 100 minutes, the ink mist adhesion to the nozzle plate occurred at 30 minutes after the start of ejection for the inkjet head 2. In addition, when the ink droplets ejected in the above "Evaluation of ink adhesion resistance" were collected in an electrically isolated aluminum box and the surface potential thereof was measured, it was confirmed that they exhibited a positive value.

That is, the cause of the mist adhering in the inkjet head 2, from the evaluation result of the nozzle plate surface potential, it is presumed that the negative charge remaining on the nozzle plate surface of the inkjet 2 has attracted the ink mist positively charged at the time of ejection to the nozzle plate by electrostatic attraction.

Example 2

<<Preparation of Nozzle Plate>>

[Preparation of Nozzle Plate 3]

In the same manner as in Example 1, a nozzle plate 3 having the configuration shown in FIG. 3 was produced in accordance with the manufacturing flow of the nozzle plate shown in FIG. 6 (Manufacturing method A).

As a substrate (2), a polyimide sheet (abbreviation: PI, UPILEX manufactured by Ube Industries, Ltd.) having a thickness of 75 μm was prepared.

On the substrate (2) prepared above, ST poly (manufactured by Achilles Corporation), which is a polypyrrole-type organic conductive polymer, was subjected to electrolytic polymerization to form a conductive layer (3) made of conductive polypyrrole and having a layer thickness of 500 nm.

Next, adjacent to the formed conductive layer (3), as a liquid repellent layer forming material, a fluorine-based compound 2 (a mixture of KBE-903 which is an amine-based silane coupling agent and manufactured by Shin-Etsu Chemical Co., Ltd., and OPTOOL DSX which is a silane group-terminated perfluoropolyether compound and manufactured by Daikin Industries, Ltd.) was used to form a liquid repellent layer (4) having a layer thickness of 20 nm by wet coating.

Specifically, an aqueous ethanol solution containing 1.0% by mass of an amine-based silane coupling agent (KBE-903, manufactured by Shin-Etsu Chemical Industry Co., Ltd.) was brush-coated directly above the conductive layer (3), and then continuously sprayed with a fluorine compound 1 (OPTOOL DSX manufactured by Daikin Industries, Ltd., a silane group-terminated perfluoropolyether compound) (hereinafter, this mixture is defined as a fluorine compound 2) and dried for 6 hours.

After each layer was formed by the above procedure, a nozzle was formed in the same manner as the nozzle plate 1 to produce the nozzle plate 3 having the configuration shown in FIG. 3.

[Preparation of Nozzle Plate 4]

In the preparation of the nozzle plate 3, the nozzle plate 4 having the structure shown in FIG. 3 was prepared in the same manner except that the conductive layer (2) was not formed.

Specifically, a polyimide sheet having a thickness of 75 μm (abbreviation: PI, UPILEX manufactured by Ube Industries, Ltd.) was prepared, and a liquid repellent layer (4) having a thickness of 20 nm using a fluorine-based compound 2 was formed on the substrate (2) by using the same method as the nozzle plate 3, and then the nozzles similar to the nozzle plate 1 was formed to produce a nozzle plate 4 having the configuration shown in FIG. 3. The nozzle plate 4 having no conductive layer (3) is a comparative example with respect to the nozzle plate 3 of the present invention.

[Preparation of Nozzle Plate 5]

In the preparation of the nozzle plate 3, the nozzle plate 5 having the configuration shown in FIG. 3 was produced in the same manner except that the liquid repellent layer (4) was not formed.

Specifically, a polyimide sheet having a thickness of 75 μm (abbreviation PI, UPILEX manufactured by Ube Industries, Ltd.) was prepared. A conductive layer (3) made of conductive polypyrrole having a layer thickness of 500 nm was formed on this substrate (2). After that, the nozzles similar to the nozzle plate 1 were formed to produce the nozzle plate 5 having the configuration shown in FIG. 3. The nozzle plate 5 having no liquid repellent layer (4) is a comparative example with respect to the nozzle plate 3 of the present invention.

<<Evaluation of Nozzle Plate>>

The nozzle plates 3 to 5 produced above were subjected to measurement of sheet resistance, determination of sheet resistance, evaluation of wipe resistance, evaluation of ink immersion resistance, evaluation of nozzle plate surface potential and ink adhesion resistance.

[Measurement of Sheet Resistance and Determination of Sheet Resistance]

The produced nozzle plates 3 to 5 were subjected to sheet resistance measurement and sheet resistance determination in the same manner as described in Example 1.

[Evaluation of Wipe Resistance and Evaluation of Ink Immersion Resistance]

Of the above-prepared nozzle plates, evaluation of wipe resistance and evaluation of ink immersion resistance were performed on the nozzle plates 3 and 4 having the liquid repellent layer (4) in the same manner as described in Example 1.

<<Preparation of Inkjet Head>>

As an inkjet head, KM1024i manufactured by Konica Minolta Co., Ltd. was prepared, and the inkjet heads 3 and 4 were produced in the same manner except that the nozzle plates 3 and 4 having a liquid repellent layer (4) were respectively provided instead of the nozzle plate provided with the inkjet head KM1024i.

[Evaluation of Ejection Stability]

The ejection stability of the inkjet head heads 3 and 4 produced above was evaluated in the same manner as described in Example 1.

[Evaluation of Nozzle Plate Surface Potential and Evaluation of Ink Adhesion Resistance]

The inkjet head heads 3 and 4 produced above were evaluated for the surface potential of the nozzle plate and the ink adhesion resistance in the same manner as described in Example 1.

Each evaluation result obtained by the above is shown in Table II.

TABLE II

| Nozzle plate and Inkjet head No. | | 3 | 4 | 5 |
|---|---|---|---|---|
| Configuration of nozzle plate | Substrate (2) | Polyimide | Polyimide | Polyimide |
| | Adhesion layer (7) | — | — | — |
| | Conductive layer (3) | Conductive polypyrrole | — | Conductive polypyrrole |
| | Under layer (8) | — | — | — |
| | Liquid repellent layer (4) | Fluorine-based compound 2 *B | Fluorine-based compound 2 *B | — |
| Sheet resistance (Ω/sq.) | | $4.40 \times 10^4$ | $7.10 \times 10^{14}$ | $2.70 \times 10^4$ |
| Determination of sheet resistance | | AA | ref. | ref. |
| Wipe resistance | | AA | AA | — |
| Ink immersion resistance | | AA | AA | — |
| Nozzle plate surface potential (kV) | After 25 seconds | 0.00 | −0.23 | — |
| | After 1 minute | 0.00 | −0.23 | — |
| Ink adhesion resistance | | AA | CC | — |
| Remarks | | Present Invention | Comparative Example | Comparative Example |

*B: Amine-based silane coupling agent and silane group-terminated perfluoropolyether As described in Table II, the sheet resistance of the ink discharge surface side of the nozzle plate 3 having a conductive layer was $4.40\times10^4$ Ω/sq, which was in the range of $5.00\times10^{14}$ Ω/sq or less. This sheet resistance was $6.2\times10^{-11}$ times (i.e., ⅔ or less) of the sheet resistance of $7.10\times10^{14}$ Ω/sq on the ink discharge surface of the nozzle plate 4 having the configuration in which only the conductive layer removed from the nozzle plate 3. Further, the sheet resistance of the nozzle plate 5 having the configuration in which only the liquid repellent layer was removed from the nozzle plate 3 was $2.70\times10^4$ Ω/sq, which was 0.61 times (i.e., ⅔ or less) the sheet resistance of the nozzle plate 3. It has been confirmed that the introduction of the conductive layer (organic conductive polymer: conductive polypyrrole) into the nozzle plate, which is the technique of the present invention, has an effect of remarkably lowering the sheet resistance on the ink discharge surface side of the nozzle plate.

In addition, it was found that the nozzle plates 3 and 4 had good wiping resistance and ink immersion resistance. That is, it was confirmed that the organic conductive polymer conductive layer had no influence on both of these resistances.

Regarding the evaluation of the ejection stability, although the results obtained are not described in Table II, both of the inkjet heads 3 and 4 prepared above showed good results. That is, it was confirmed that the organic conductive polymer conductive layer did not affect the formation of nozzle holes by laser processing.

The surface potential of the nozzle plate after the ink extrusion was 0.00 kV after 25 seconds in the inkjet head 3, and −0.23 kV even after 1 minute in the inkjet head 4 of the comparative example. This shows that the organic conductive polymer conductive layer satisfying the sheet resistance determination has an effect of quickly transferring the negative charge generated in the nozzle plate by the ink extrusion to the outside of the nozzle plate, similarly to the inkjet head 1 having the carbon conductive layer of Example 1.

Next, looking at the ink adhesion resistance results described in Table II, although the ink mist did not adhere to the nozzle plate even after 100 minutes of continuous ejection of the inkjet head 3, the ink mist adhesion to the nozzle plate occurred at 10 minutes after the start of ejection of the inkjet head 4.

When combined with the results of Example 1 described above, while the inkjet heads 1 and 3 having the nozzle plate surface potential of 0.00 kV after one minute of ink extrusion did not adhere mist for a long time, the ink mist adhesion occurred 30 minutes after the start of ejection in the inkjet head 2 having the nozzle plate surface potential of −0.01 kV, and 10 minutes after the start of ejection in the inkjet 4 having the nozzle plate surface potential as large as −0.23 kV. From the above, it can be seen that the larger the negative charge amount on the surface of the nozzle plate 1 minute after the ink is extruded, the more the ink mist adheres.

Example 3

<<Preparation of Nozzle Plate>>

[Preparation of Nozzle Plate 6]

According to the manufacturing flow of the nozzle plate described in FIG. 6 (Manufacturing method A), a nozzle plate 6 made of the configuration described in FIG. 3 was produced.

As a substrate (2), a polyimide sheet (abbreviation: PI, UPILEX manufactured by Ube Industries, Ltd.) having a thickness of 75 μm was prepared.

On the substrate (2) prepared above, an adhesion layer (7) composed of silicon oxide and having a layer thickness of 10 nm was formed by sputtering using a silicon oxide target.

Next, a conductive layer (3) having a layer thickness of 5 nm composed of a tin-doped indium oxide was formed by sputtering using a tin-doped indium oxide target adjacent to the adhesion layer (7) formed above.

Then, an underlayer (8) composed of silicon oxide and having a thickness of 5 nm was formed by sputtering using a silicon oxide target adjacent to the conductive layer (3) formed above. Then, a fluorine-based compound 1 (OPTOOL DSX manufactured by Daikin Industries, Ltd., a silane group-terminated perfluoropolyether compound) was used as a liquid repellent layer forming material, and a liquid repellent layer (4) having a layer thickness of 5 nm was formed adjacent to the above-formed underlayer (8) by spray coating.

After forming each layer in the above procedure, the nozzles were formed in the same manner as the nozzle plate 1 to produce a nozzle plate 6 made of the configuration described in FIG. 3.

[Preparation of Nozzle Plate 7]

In the production of the nozzle plate 6, the nozzle plate 7 having the structure shown in FIG. 3 was produced in the same manner except that the underlayer (8) and the liquid repellent layer (4) were not formed.

Specifically, a polyimide sheet having a thickness of 75 μm (abbreviation PI, UPILEX manufacture d by Ube Industries, Ltd.) was prepared. On this substrate (2), a 10 nm adhesion layer (7) made of a silicon oxide and a conductive layer (3) made of a tin-doped indium oxide and having a layer thickness of 5 nm were formed. Thereafter, the nozzles similar to the nozzle plate 1 were formed to produce the nozzle plate 7 having the configuration shown in FIG. 3.

The nozzle plate 7 without the underlayer (8) and the liquid repellent layer (4) is a comparative example with respect to the nozzle plate 6 of the present invention.

<<Evaluation of Nozzle Plate>>

The nozzle plates 6 and 7 thus produced were subjected to measurement of sheet resistance, determination of sheet resistance, evaluation of wipe resistance, evaluation of ink immersion resistance, evaluation of nozzle plate surface potential and ink adhesion resistance.

[Measurement of Sheet Resistance and Determination of Sheet Resistance]

The sheet resistance was measured and the sheet resistance was determined in the same manner as described in Example 1 with respect to the nozzle plates 6 and 7 manufactured as described above.

[Evaluation of Wipe Resistance and Evaluation of Ink Immersion Resistance]

The wipe resistance and the ink immersion resistance of the nozzle plate 6 having the liquid repellent layer (4) were evaluated in the same manner as described in Example 1.

<<Preparation of Inkjet Head>>

As an inkjet head, KM1024i manufactured by Konica Minolta, Inc. was prepared. An inkjet head 6 was produced in the same manner except that the nozzle plate 6 having the liquid repellent layer (4) was provided instead of the nozzle plate provided with KM1024i.

[Evaluation of Ejection Stability]

The ejection stability of the inkjet head 6 produced above was evaluated in the same manner as described in Example 1. The results were good. That is, it was confirmed that the tin-doped indium oxide conductive layer did not affect the nozzle hole formation by laser processing.

[Evaluation of Nozzle Plate Surface Potential and Evaluation of Ink Adhesion Resistance]

The inkjet head 6 produced as described above was evaluated for the surface potential of the nozzle plate and the ink adhesion resistance in the same manner as described in Example 1.

Each evaluation result obtained by the above is shown in Table III.

TABLE III

| Nozzle plate and Inkjet head No. | | 6 | 7 |
|---|---|---|---|
| Configuration of nozzle plate | Substrate (2) | Polyimide | Polyimide |
| | Adhesion layer (7) | Silicon oxide | Silicon oxide |
| | Conductive layer (3) | Tin-doped indium oxide | Tin-doped indium oxide |
| | Under layer (8) | Silicon oxide | — |
| | Liquid repellent layer (4) | Fluorine-based compound 1 *A | — |
| Sheet resistance (Ω/sq.) | | $1.10 \times 10^5$ | $2.60 \times 10^4$ |
| Determination of sheet resistance | | AA | ref. |
| Wipe resistance | | AA | — |
| Ink immersion resistance | | BB | — |
| Nozzle plate surface potential (kV) | After 25 seconds | −0.01 | — |
| | After 1 minute | 0.00 | — |
| Ink adhesion resistance | | AA | — |
| Remarks | | Present Invention | Comparative Example |

*A: Silane group-terminated perfluoropolyether group compound

As described in Table III, the sheet resistance of the ink discharge surface side of the nozzle plate 6 having a conductive layer was $1.10\times10^5$ Ω/sq, which was in the range of $5.0\times10^{14}$ Ω/sq or less. On the other hand, the sheet resistance of the nozzle plate 7 having the configuration in which the liquid repellent layer and the underlayer were removed from the nozzle plate 6 was $2.60\times10^4$ Ω/sq, which was 0.24 times (i.e., ⅔ or less) the sheet resistance of the nozzle plate 6. From the above, it was confirmed that the introduction of the conductive layer (tin-doped indium oxide) to the nozzle plate has an effect of lowering the sheet resistance on the ink discharge surface side of the nozzle plate even when the adhesion layer (7) is formed, as in the configuration defined in the present invention.

Further, as described in Table III, the surface potential of the nozzle plate after the ink extrusion of the inkjet head 6 was −0.01 kV after 25 seconds, and 0.00 V after 1 minute.

Next, looking at the results of the ink adhesion resistance described in Table III, inkjet mist did not adhere to the nozzle plate of the inkjet head 6 even after 100 minutes of continuous ejection.

When the results of Example 1 and Example 2 are combined, it can be seen that the mist does not adhere to the inkjet heads 1, 3 and 6 for a long period of time. The inkjet heads 1, 3 and 6 have a surface potential of the nozzle plate of 0.00 kV.

From the above, it has been shown that the inkjet head having the nozzle plate of the present invention in which the sheet resistance determination becomes "AA" by the introduction of the conductive layer has a nozzle plate surface potential of 0.00 kV after 1 minute of ink extrusion, thus reducing the ink mist adhesion in continuous ejection, thereby enabling a long time stable ejection.

Example 4

<<Preparation of Nozzle Plate>>

[Preparation of Nozzle Plate 8]

According to the manufacturing flow of the nozzle plate described in FIG. 6 (Manufacturing method A), a nozzle plate 8 having the configuration described in FIG. 3 was produced.

As a substrate (2), a polyimide sheet (abbreviation: PI, UPILEX manufactured by Ube Industries, Ltd.) having a thickness of 75 μm was prepared.

On the prepared substrate (2) described above, a conductive layer (3) composed of a tin-doped indium oxide having a thickness of 5 nm was formed by sputtering using a tin-doped indium oxide target.

Next, adjacent to the conductive layer (3) formed above, an underlayer (8) composed of silicon oxide having a thickness of 10 nm was formed by sputtering using a silicon oxide target. Then, a fluorine-based compound 1 (OPTOOL DSX manufactured by Daikin Industries, Ltd., a silane group-terminated perfluoropolyether compound) was used as a liquid repellent layer forming material, and a liquid repellent layer (4) having a layer thickness of 5 nm was formed by spray coating adjacent to the above-formed underlayer (8).

After forming each layer by the above procedure, nozzles were formed in the same manner as the nozzle plate 1, and the nozzle plate 8 having the configuration shown in FIG. 3 was produced.

[Preparation of Nozzle Plate 9]

In the preparation of the nozzle plate 1 described in Example 1, a nozzle plate 9 having the configuration shown in FIG. 3 was produced in the same manner except that the type of the substrate (2) was changed as described below.

Specifically, polyphenylene sulfide (abbreviation: PPS, TORELINA manufactured by Toray Corporation) having a thickness of 50 μm was prepared as the substrate (2). On this substrate (2), a conductive layer (3) composed of amorphous carbon and having a thickness of 20 nm, an underlayer (8) composed of carbonized silicon oxide and having a thickness of 5 nm, and a liquid repellent layer (4) composed of a fluorine compound 1 and having a thickness of 5 nm was formed by using the same method as production of the nozzle plate 1. Thereafter, the nozzles similar to the nozzle plate 1 were formed, and the nozzle plate 9 having the configuration shown in FIG. 3 was produced.

The nozzle plate 9 of the present invention has a configuration in which the base material is changed with respect to the nozzle plate 1.

<<Evaluation of Nozzle Plate>>

With respect to the nozzle plates 8 and 9 produced as described above, the sheet resistance was measured and the sheet resistance was determined by the same method as that described in Example 1.

[Measure of Sheet Resistance and Determination of Sheet Resistance]

The sheet resistance was measured and the sheet resistance was determined in the same manner as described in Example 1 with respect to the nozzle plates 8 and 9 manufactured as described above.

The results obtained as described above are shown in Table IV

TABLE IV

| Nozzle plate and Inkjet head No. | | 8 | 9 |
|---|---|---|---|
| Configuration of nozzle plate | Substrate (2) | Polyimide | Polyphenylene sulfide |
| | Adhesion layer (7) | — | — |
| | Conductive layer (3) | Tin-doped indium oxide | Carbon |
| | Under layer (8) | Silicon oxide | Carbonized silicon oxide |
| | Liquid repellent layer (4) | Fluorine-based compound 1 *A | Fluorine-based compound 1 *A |
| Sheet resistance (Ω/sq.) | | $3.80 \times 10^8$ | $1.60 \times 10^{14}$ |
| Determination of sheet resistance | | AA | AA |
| Remarks | | Present Invention | Present Invention |

*A: Silane group-terminated perfluoropolyether group compound

As shown in Table IV, the sheet resistance of the nozzle plate 8 and the sheet resistance of the nozzle plate 9 on the ink discharge surface side were $3.80\times10^8$ Ω/sq and $1.60\times10^{14}$ Ω/sq, respectively, and these sheet resistances were in the range of $5.0\times10^{14}$ Ω/sq or less. From the above, it was confirmed that the nozzle plate having the sheet resistance determination "AA" may be composed of various materials and thicknesses for the substrate (2), the adhesion layer (7), the conductive layer (3), the underlayer (8), and the liquid repellent layer (4).

INDUSTRIAL APPLICABILITY

The inkjet head provided with the nozzle plate of the present invention has excellent ejection stability and may be suitably used in inkjet printers using inks of various fields.

DESCRIPTION OF SYMBOLS

1: Nozzle plate
2: Substrate
3: Conductive layer
4: Liquid repellent layer
5: Nozzle hole
6: Ink droplet
7: Adhesion layer
8: Underlayer
9: Protective sheet
10: Laser beam irradiation device
11: Atmospheric pressure oxygen plasma device
12: Nozzle through hole
56: Housing
57: Cap receiving plate
59: Cover member
61: Nozzle plate
62: Cap carrier plate attachment portion
68: Mounting hole
71: Nozzle opening
81*a*: First joint
81*b*: Second joint
82: Third joint
100: Inkjet head
A: Ashing
E: Dry etching

What is claimed is:

1. An inkjet head comprising: a substrate having a nozzle hole; and a nozzle plate having a liquid repellent layer on an outermost surface of the substrate on an ink discharge surface side, wherein the nozzle plate has a conductive layer between the substrate and the liquid repellent layer;

wherein the nozzle plate has an underlayer between the conductive layer and the liquid repellent layer, wherein the underlayer contains one or more kinds of metal elements selected from the group consisting of tantalum, zirconium, hafnium, niobium, titanium, tungsten, cobalt, molybdenum, vanadium, lanthanum, manganese, chromium, yttrium, praseodymium, ruthenium, rhodium, iridium, cerium, and aluminum, and contains one or more kinds of elements selected from the group consisting of oxygen, nitrogen, and carbon, and wherein in a case that the underlayer contains hafnium, titanium or zirconium, oxygen is not selected from the group consisting of oxygen, nitrogen, and carbon.

2. The inkjet head described in claim 1, wherein a sheet resistance on the ink discharge surface side of the nozzle plate is equal to or less than ⅔ of a sheet resistance on a liquid repellent layer side of a plate having a configuration excluding only the conductive layer from the nozzle plate.

3. The inkjet head described in claim 1, wherein a sheet resistance on the ink discharge surface of the nozzle plate is equal to or less than $5.0\times10^{14}$ Ω/sq.

4. The inkjet head described in claim 1, wherein the nozzle plate has an adhesion layer between the substrate and the conductive layer.

5. The inkjet head described in claim 1, wherein the nozzle plate has an adhesion layer between the substrate and the conductive layer.

6. The inkjet head described in claim 1, wherein the substrate is a non-metallic material.

7. The inkjet head described in claim 1, wherein the underlayer contains a compound selected from the group consisting of silicon oxide, oxidized silicon carbide, tantalum silicate, and carbonized silicon oxide.

8. The inkjet head described in claim 1, wherein the underlayer is made of polyamide or isocyanate.

9. The inkjet head described in claim 1, wherein the substrate is made of silicon, polyimide, polyphenylene sulfide, or polyethylene terephthalate.

10. The inkjet head described in claim 1, wherein the liquid repellent layer contains a fluorine-based compound, and the fluorine-based compound is either (1) or (2):

(1) a compound having a perfluoroalkyl group containing at least an alkoxysilyl group, a phosphonic acid group or a hydroxy group, or a compound having a perfluoropolyether group containing an alkoxysilyl group, a phosphonic acid group or a hydroxy group; or (2) a mixture comprising a compound having a perfluoroalkyl group, or a mixture comprising a compound having a perfluoropolyether group.

11. The inkjet head described in claim 1, wherein in the nozzle plate, the substrate is formed of a resin material, and the conductive layer is formed of a sublimable compound.

12. The inkjet head described in claim 11, wherein the sublimable compound constituting the conductive layer is a tin-doped indium oxide or a carbon material.

13. The inkjet head described in claim 1, wherein in the nozzle plate, the substrate is formed of a resin material, and the conductive layer is formed of an organic conductive polymer.

14. An image forming method using the inkjet head described in claim 1, comprising the step of forming an image using an ink, wherein the ink used for image formation contains a hydrocarbon having an ether group or a hydroxy group as a solvent in an amount of 40% by mass or more based on the total mass of the ink.

15. An inkjet head comprising: a substrate having a nozzle hole; and a nozzle plate having a liquid repellent layer on an outermost surface of the substrate on an ink discharge surface side, wherein the nozzle plate has a conductive layer between the substrate and the liquid repellent layer;

wherein the nozzle plate has an underlayer between the conductive layer and the liquid repellent layer, and wherein the underlayer contains tantalum silicate.

16. The inkjet head described in claim 15, wherein the underlayer contains one or more kinds of metal elements selected from the group consisting of tantalum, zirconium, hafnium, niobium, titanium, tungsten, cobalt, molybdenum, vanadium, lanthanum, manganese, chromium, yttrium, praseodymium, ruthenium, rhodium, iridium, cerium, and aluminum, and contains one or more kinds of elements selected from the group consisting of oxygen, nitrogen, and carbon.

* * * * *